US006075500A

United States Patent [19]

Kurz et al.

[11] Patent Number: 6,075,500

[45] Date of Patent: Jun. 13, 2000

[54] COMPACT ANTENNA MEANS FOR PORTABLE RADIO COMMUNICATION DEVICES AND SWITCH-LESS ANTENNA CONNECTING MEANS THEREFOR

[75] Inventors: Hans Peter Kurz, Akersberga, Sweden; Howard William Johnson, Franklin, Tenn.

[73] Assignee: Allgon AB, Akersberga, Sweden

[21] Appl. No.: 09/068,733

[22] PCT Filed: Nov. 15, 1996

[86] PCT No.: PCT/SE96/01488

§ 371 Date: Jun. 1, 1998

§ 102(e) Date: Jun. 1, 1998

[87] PCT Pub. No.: WO97/18600

PCT Pub. Date: May 22, 1997

Related U.S. Application Data

[60] Provisional application No. 60/006,768, Nov. 15, 1995.

[51] Int. Cl.[7] ..... H01Q 1/24

[52] U.S. Cl. ..... 343/895; 343/906

[58] Field of Search ..... 343/702, 906, 343/895, 900, 700 MS

[56] References Cited

U.S. PATENT DOCUMENTS

| | | | |
|---|---|---|---|
| 4,868,576 | 9/1989 | Johnson, Jr. | 343/702 |
| 5,262,792 | 11/1993 | Egashira | 343/702 |
| 5,357,262 | 10/1994 | Blaese | 343/906 |
| 5,446,469 | 8/1995 | Makino | 343/702 |
| 5,479,178 | 12/1995 | Ha | 343/702 |
| 5,504,494 | 4/1996 | Chatzipetros | 343/702 |
| 5,524,284 | 6/1996 | Marcou et al. | 455/90 |
| 5,835,064 | 11/1998 | Gomez et al. | 343/702 |
| 5,861,851 | 1/1999 | Chang | 343/702 |

FOREIGN PATENT DOCUMENTS

| | | | |
|---|---|---|---|
| 0590534 | 4/1994 | European Pat. Off. | H01Q 1/24 |
| WO95/08853 | 3/1995 | WIPO | H01Q 9/00 |

*Primary Examiner*—Don Wong
*Assistant Examiner*—Shih-Chao Chen
*Attorney, Agent, or Firm*—Jacobson, Price, Holman & Stern, PLLC

[57] ABSTRACT

Antenna means for a portable radio communication device is disclosed. It includes a radiating first element having a meander geometry being relatively flat and without any complete loops or turns, a radiating second element having a meander, helical, rectangular or straight geometry. The first and second elements interact to provide one or more modes of antenna operation and the first element feeds the second element in at least one operational mode. Further, an extendable and retractable feature of the second element is disclosed, as well as an antenna adapter for external connection of the inventive antenna means to an auxiliary antenna.

18 Claims, 28 Drawing Sheets

PRIOR ART

COMPACT ANTENNA MEANS FOR PORTABLE RADIO COMMUNICATION DEVICES AND SWITCH-LESS ANTENNA CONNECTING MEANS THEREFOR

This application claims the benefit of U.S. provisional application Ser. No. 60/006,768, entitled "Transmitting and/or receiving arrangements for electronic devices and method therefor", filed Nov. 15, 1995.

This application is National Stage of International Application PCT/SE/96/01488 Under 35 USC 371, filed Nov. 15, 1996.

FIELD OF THE INVENTION

The present invention relates to a compact antenna means intended for mobile or portable radio devices such as cellular telephones, portable computers and terminals having a radio communication function, and similar devices. The invention also relates to a connection means or externally connecting the compact antenna means to a transmission line to enable a further connection to an auxiliary antenna or other signal source.

The electrical length and the physical length of an antenna can be different. Some electronic communication devices, such as American cellular phones are operating from the 824 MHz to the 894 MHz band. Broad band width antennas are desired for devices that work in either one band or that work in multiple bands if the device is multifunctional. A quarter wavelength long dipole means that the electrical length of one half of the dipole is a quarter of the wavelength for which the dipole antenna is designed. At a frequency of 1 GHz the wavelength in free space is approximately 30 cm which means that each end of a quarter wave dipole is approximately 7.5 cm long. An antenna which is electrically one quarter wavelength long has similar complex Return-Loss values as a cylindrical dipole. The complex S11-parameter values of a cylindrical dipole are described in many books such as the "Jasik, Antenna Engineering Handbook". The physical length of an antenna can be reduced by winding the cylindrical dipole (for example: a wire) into a helical shape or a zigzag shape. Any oval cross section shapes geometrically between those two (round and flat) extremes are also possible. Besides having good S11-Parameter values the antenna should have horizontal gain characteristics. The electrical horizontal gain of an antenna increases with its electrical length up to the point at which it is one half a wavelength. The Return Loss values (also called the S11-parameter), on the other hand, has its optimum electrical length approximately one quarter wavelength when no matching circuit is used. Therefore many antenna assemblies use a quarter wavelength antenna without a matching circuit. Others use an electrical ⅜ wavelength antenna or ½ wavelength antenna with a matching circuit between the antenna and the Receiving/Transmitting Duplexer device. Most of the electronic devices use transmission lines with 50 Ohm, or 200 Ohm resistance such as a RG58 coaxline. Typically, at the present time, the frequency bands that the afore mentioned antennas operate in are between 100 MHz and 3 GHz.

In many applications, the plastic housing of the electronic communication device is protected against interference problems by an electrically conductive shielding. This shielding protects the internal devices from unwanted external electromagnetic waves and also protects other nearby electrical equipment from interference that is generated inside the device itself. This shielding can be used as one a part of the dipole antenna. It can also act as an electrical ground plane depending on its size.

DESCRIPTION OF PRIOR ART

The prior art documents U.S. Pat. Nos. 4,868,576, 5,446,469, 5,479,178, 5,504,494, 5,262,792, WO 95/08853, EP-A1-0 590 534 all disclose antenna means including helical antenna structures. However, in spite the fact that a helical antenna structure provides a more compact configuration than, e.g., a straight radiator antenna, it suffers from several drawbacks. The gain and bandwidth is typically smaller. In addition, the volume occupied by a helical structure is still considerable, since the helix requires a relatively large diameter in order to attain a satisfactory antenna function.

The volume of the helix is calculated by the Formula: r*r*pi*h. Where r is the radius and h the height. The radius cannot be decreased since the height then becomes either too large to be practical or the electrical length or the antenna is changing, i.e., getting longer or shorter than a quarter wavelength. A typical volume of a helix for the GSM system would be 3 mm*3 mm*pi*18 mm=508.9 $mm^3$.

Further, due to the larger diameter of the helix, a helical antenna, mounted on a hand-portable telephone projecting upwards, generally cannot be situated as far from the user's head as a "thinner" straight radiator antenna. Thus, greater amount of radiation from a helica antenna will be absorbed and affected otherwise by he user's head. L-tendable antennas generally have the advantage to increase the distance to the human head obtaining two advantages: less screening of the gain of the antenna by the human head and less energy absorbed by the human body, especially the head.

One possible solution for moving the antenna further away from the telephone is provided in U.S. Pat. No. 5,524,284, which discloses a switch-less antenna adapter for connecting a hand-portable telephone to a transmission line and another remotely situated antenna. However, that document fail to suggest a switch-less antenna connecting means that enables connection of a telephone to a remote antenna without actually removing the antenna mounted on the telephone.

SUMMARY OF THE INVENTION

Consequently, it is an object of the invention to provide an antenna connecting means having a broad frequency range, high gain, and being extremely compact, suited for large scale production, and adaptability to various design shapes.

Also, it is an object of the invent-an to provide an antenna means which includes at least one radiating element that can be moved to and out of a position where it enhances substantially the performance of the antenna means.

A further object of the invention is to provide an antenna connection means that offers switch-less connection of the an antenna means to a transmission line and/or an auxiliary antenna.

These and other objects are attained by antenna means and antenna connecting means according to the appended claims.

The coupling distance between radiating elements should be minimized to get high currents into the extendable element for good gain characteristics. For a helical structure it is limited to the radius of the helix, which cannot be minimized in order for the electrical length not to deviate from an intended value or not to exceed a certain height limit preferred by the user. In the case of a meander configuration of the first element the coupling distance between first and second elements can be minimized, down to a few micrometers if required.

Some advantages of the invention are indicated below. With a meander or zigzag antenna much less space is required. The total volume can be calculated by the formula: 1*w*t, where 1 is the length, w is the width, and t is the thickness of the conductive element. Typical numbers for a meander element using copper foil for the GSM system would be: 0.04 mm*40 mm*18 mm=28.8 $mm^3$.

The term "meander configuration without complete turns" is used herein to define geometrical structures of radiating elements which, for example, can be obtained when producing the radiating elements as printed circuits on a flexible film substrate that is originally flat, but can be bent into various curved configuration that are still "thin" and that may, for example, adapt to a corresponding curvature of a chassis of a hand-portable cellular telephone. Specifically, the omission helical structures for providing the essential radiating functions, at least in one of several possible operating modes, offers more a effective solution to the objective problems of the invention.

The first meander or zigzag part included in the invention can either as a normal mode antenna, preferably without any matching circuit. This saves costs and space, and electrical losses in the matching circuit are avoided. The second part, also included in an inventive concept, is preferably half a wavelength, is movably mounted to capacitively couple to the first part of the antenna means, causing the S11 parameter of the antenna to achieve very broad band characteristics. Achieving S11 parameters below −10 dB over 40% of the complete frequency band seems possible. This broad S11 parameter band can also be used for dual band applications, i.e., to make a telephone operable mi different frequency bands, e.g., DECT and GSM.

Gain in the extended capacitively coupled mode is very good. In experiments +2 dB over a typical frequency band for PCS frequency band was attained. The influence on the human body is smaller than for conventional antennas, since the extended part may be placed on a hand-portable telephone at maximum distance from the users head. This results in low SAR, thereby reducing any potential health risks and improving the antenna performance.

As stated above, no impedance matching means is required provided that the first element is designed correctly, i.e., given an effective length of approximately one quarter wavelength. If the second element is approximately one half a wavelength the matching means may still be omitted when both elements of the antenna means are in operation. The complexity of the antenna means is low, since no switching means or other conductive connection means is used for coupling the first and second elements. This allows an extremely compact design of the antenna means. If further size reduction is required, inductive elements could be used in a well known manner without severely affecting the antenna performance.

As industrial design is increasingly important in the technical field of antennas, the inventive antenna means offers great flexibility in achieving new design goals.

A first radiating element may be transformed into a transmission line or part of a transmission line by a antenna connecting means according to the invent on. This is achieved by only two coupling points, preferably providing conductive contact, and may involve a slidable connector. Usually a telephone has to be switched off when an external antenna is to be connected to it. In the inventive solution that is not necessary since the first element forms, immediately in parallel to and in combination with a similar conductor, a transmission line. No switch means is required. Hereby compactness, operability, efficiency in the transmission of signals between the transceiver circuitry and a remotely situated antenna or other signal source.

A combination of the inventive antenna means, including a retractable element, and the antenna connecting means replaces the following parts of a conventional hand-portable cellular telephone: impedance matching means, switching means for improving performance temporarily (during a call), and external connection switching means.

PREFERRED EMBODIMENTS OF THE INVENTION

Figures 1, 2:
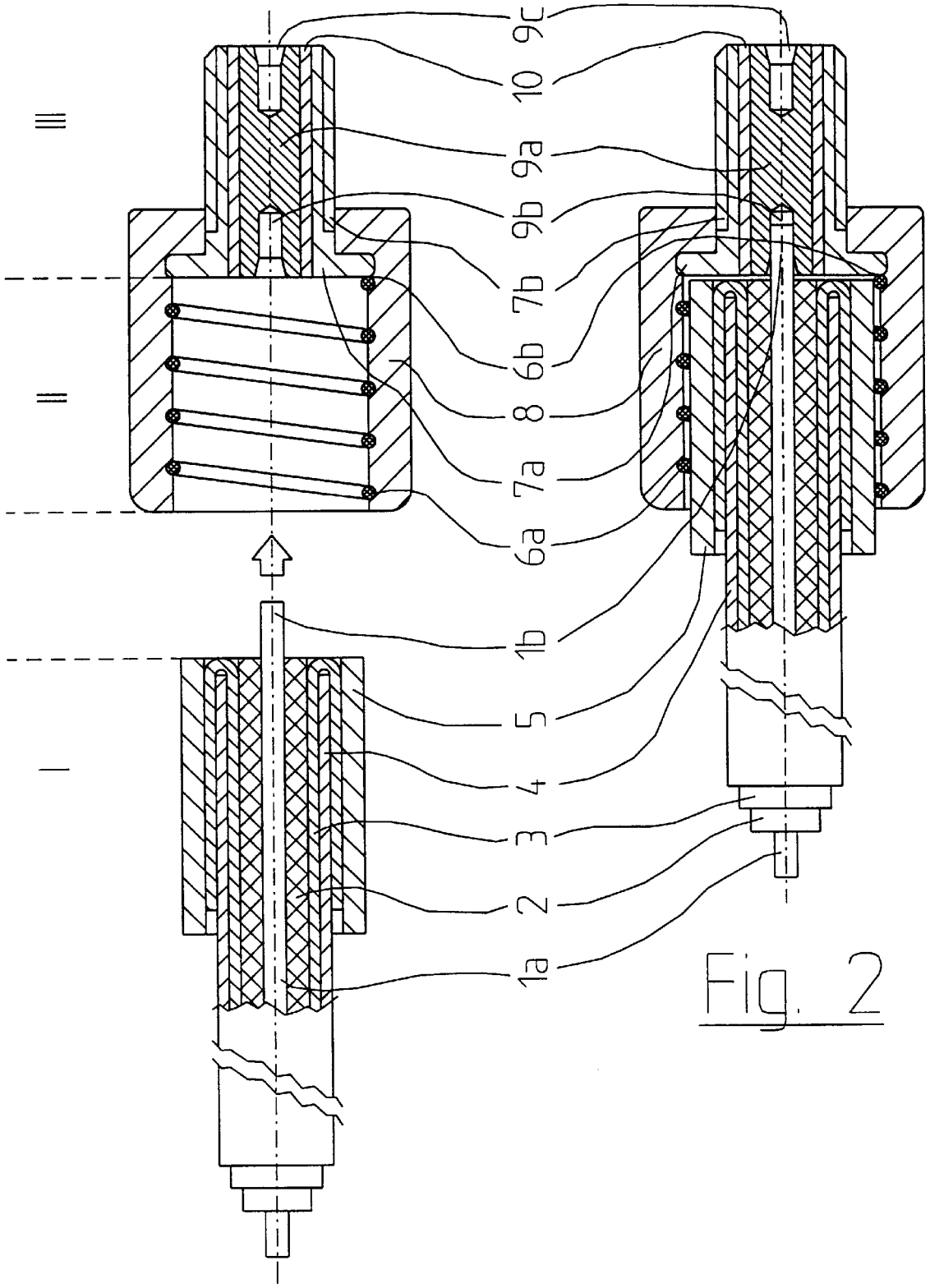
FIGS. 1–2 show in combination a connector (I), an antenna means (II) for a radio device, and a Feed portion (III) of the antenna means, together forming an external connecting means of the invention.

FIG. 1 shows the cross section view of a sliding-connector I and an antenna II and III. The sliding-connector, section I, is made up of a coaxial line with a center coaxial conductor 1*a,* a galvanic connector 1*b* (e.g. pin, socket, or any other commonly used galvanic connector), a dielectric material 2 such as Teflon, the outer coaxial conductor 3 such as a flexible metal braid, and a covering plastic material 4. The outer coaxial conductor 3 is connected to a conductive tubular connector 5. The other end of this coaxial line 1*a,* 2, 3, 4 is connected to an external antenna (not shown) or to any device that can make use of the signal. An external antenna provides a stronger electrical signal than is normal for a device mounted antenna due to its better location or its better antenna characteristics.

Section II shows the normal mode helical antenna with its windings 6*a,* its attachment 6*b* to the conductive base connector 7*a* and its non-conductive covering material 8, preferably made out of a plastic substance.

Section III shows the coaxial connector portion of the antenna. This portion has a conductive center pin 9*a* which has a mating end 9*b* that is capable or mating with galvanic connector 1*b.* This section also shows mating end 9*c* and a dielectric insulation 10. In this embodiment the conductive base connector 7*a* also has a threaded OD shown on the drawing as 7*b.* The connector III can be screwed into a transmission/reception line jack of a transmission/reception device (not shown). Inside the transmission/reception device this jack is connected with a electronic Duplexer circuit or a Transmission/Receiving circuit, etc. (also not shown).

FIG. 2 shows the sliding-connector I device and the antenna II, III device from FIG. 1 in the "plugged-in" or mated position. The sliding-connector I is slid into the antenna II. The conductive tubular connector 5 contacts all of the windings 6*a* of the antenna II thus shorting them down and galvanically connecting the conductive base connector 7*a,* 7*b* with the outer coaxial conductor 3. This insertion also mates galvanic connector 1*b* with mating end 9*b* on conductive center pin 9*a* resulting in a galvanic connection between conductive center pin 9*a* and center coaxial conductor 1*a.* The effect of connecting the afore mentioned parts is an electrical switching off of the antenna and a switching on of the coaxial line (and any device on the other end of the coaxial line) to the internal circuits that fed the antenna.

Figure 3:
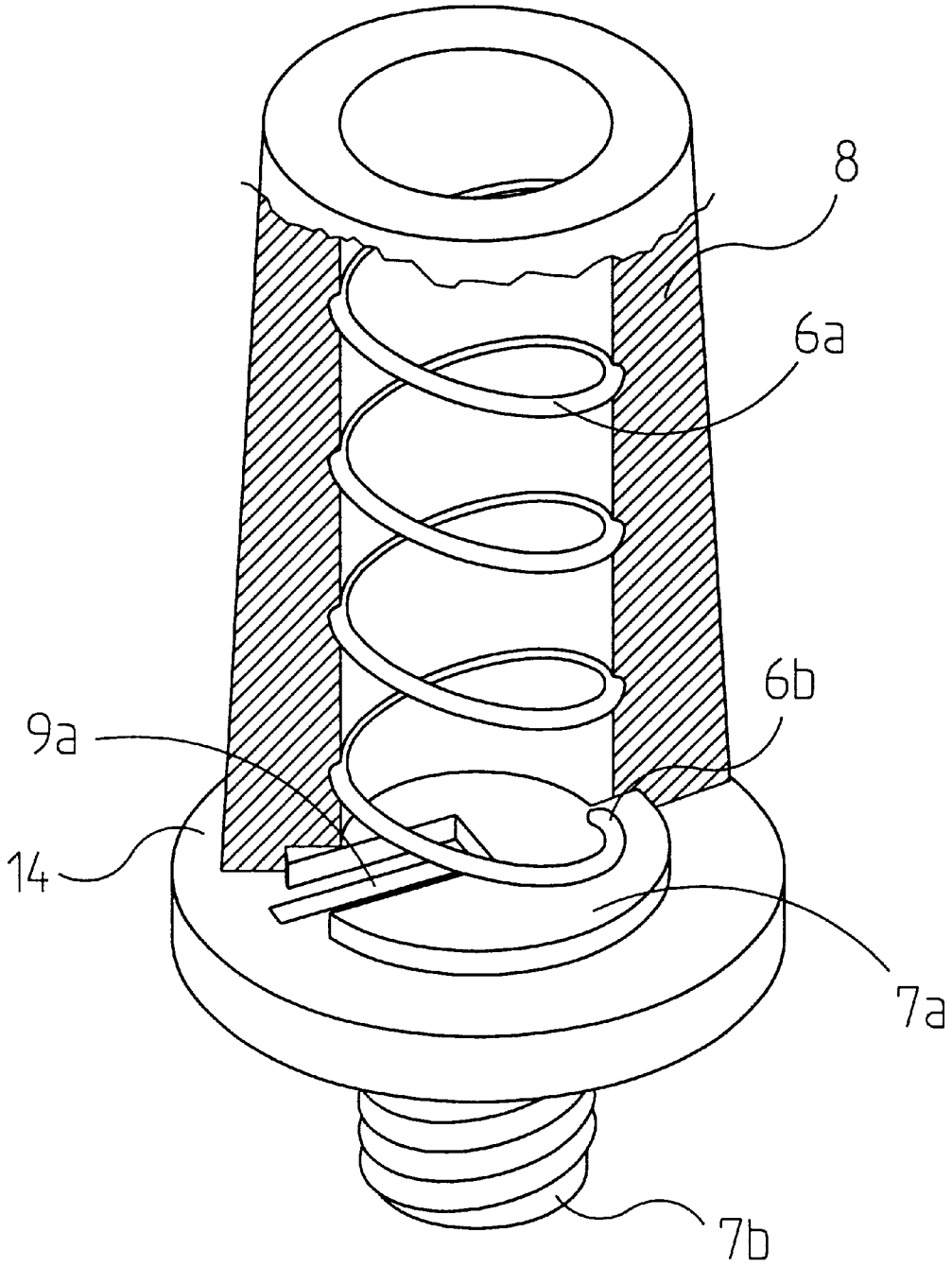
FIG. 3–4 shows an embodiment of an antenna means and an associated feed portion alternative to those of FIGS. 1–2.

FIG. 3 shows the antenna II, III of FIG. 1 and FIG. 2 in an alternate embodiment. Again it can be used as a helical antenna and it still provides the mechanism allowing a coaxial line to be easily plugged into the antenna. The transmitted energy that would have been transmitted by the antenna is now switched into and carried by the coaxial line. The conductive base connector 7 now receives the signal From the coaxial line. The antenna has helical windings 6*a* which have an electrical connection to a conductive base connector 7*a.* The helical windings 6*a* are covered on their outside diameter, and there-ore protected with non-conductive covering material B and the inside of the assembly is hollow with the inside diameter of the windings 6*a* being smaller than the inside diameter of the non-conductive covering material 8. At the bottom of the device is a conductive washer 14 and a conductive center pin 9*a* bent at an angle and affixed to conductive washer 14 to provide galvanic contact between pin 9 and washer 14. Non-conductive covering material 8 also insulate washer 14/pin 9*a* assembly from winding 6*a*/connector 7*a, b* assembly.

Figure 4:
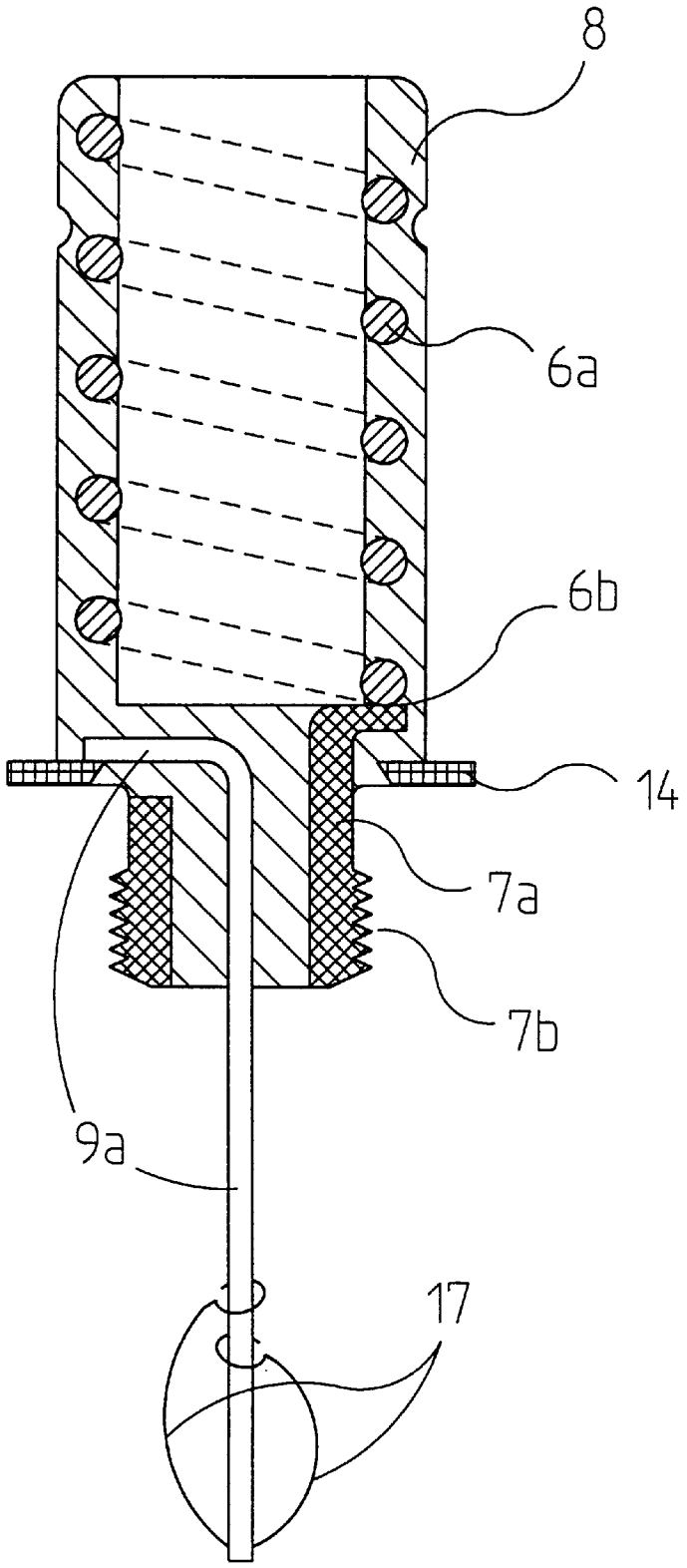

FIG. 4 shows the antenna of FIG. 3 in a cross section view with the addition of an extended conductive center in 9*a* which acts as a ground connection device using spring fingers 17. Spring fingers 17 provide a connection to the electrical ground inside the phone. This connection can be either made onto the PC board or onto the conductive paint inside the case of the transmission /reception device into which connector 7*a, b,* is threaded. The helical windings 6*a* have preferably an electrical length of a quarter wavelength.

Figure 5:
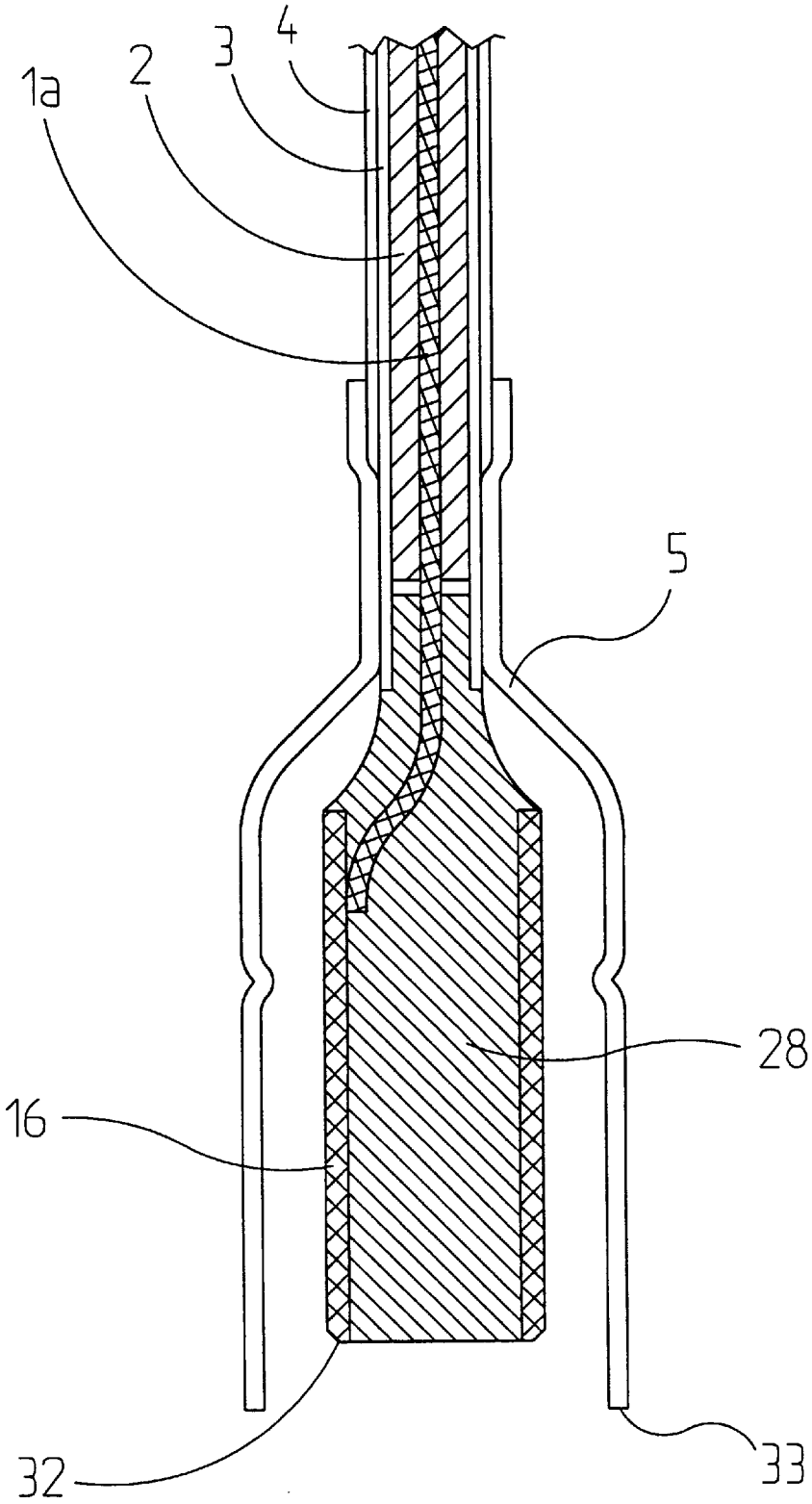
FIG. 5 shows an embodiment of the a connector alternative to that of FIGS. 1–2 and intended for the antenna means of FIGS. 3–4.

FIG. 5 shows the sliding connector which slides into the antenna of FIG. 3 and FIG. 4. The outer coaxial conductor 3 is connected to conductive tabular connector 5. The center coaxial conductor 1*a* of the coaxial line 1*a,* 2, 3, 4 is connected to a galvanic connector 16 (in this embodiment the connector 16 is a conductive tube). To stabilize the galvanic connector 16 and to insulate the assembly 16, 1*a* from the assembly 3, 5 a non-conductive support insulator 28 is used.

The coaxial line 1*a,* 2, 3, 4 can be replaced by any other transmission line (such as a shielded parallel line or a parallel transmission line etc.) which is appropriate for the frequency(s) that the device is transmitting and/or receiving.

When the sliding connector (FIG. 5) is slid together with the antenna (FIG. 3 and FIG. 4) the outside of the galvanic connector 16 shorts the helical windings 6*a* of the antenna. The bottom portion 32 of galvanic connector 16 makes a galvanic contact with the conductive base connector 7*a* while the bottom portion 33 of conductive tubular connector 5 makes a galvanic connection to conductive washer 14. These connections cause the antenna to disappear electrically and the two parts become a transmission line of a wanted (Feldwellenwiderstand) transmission-line, resistance characteristics (in most applications 50 Ohm).

Figure 6:
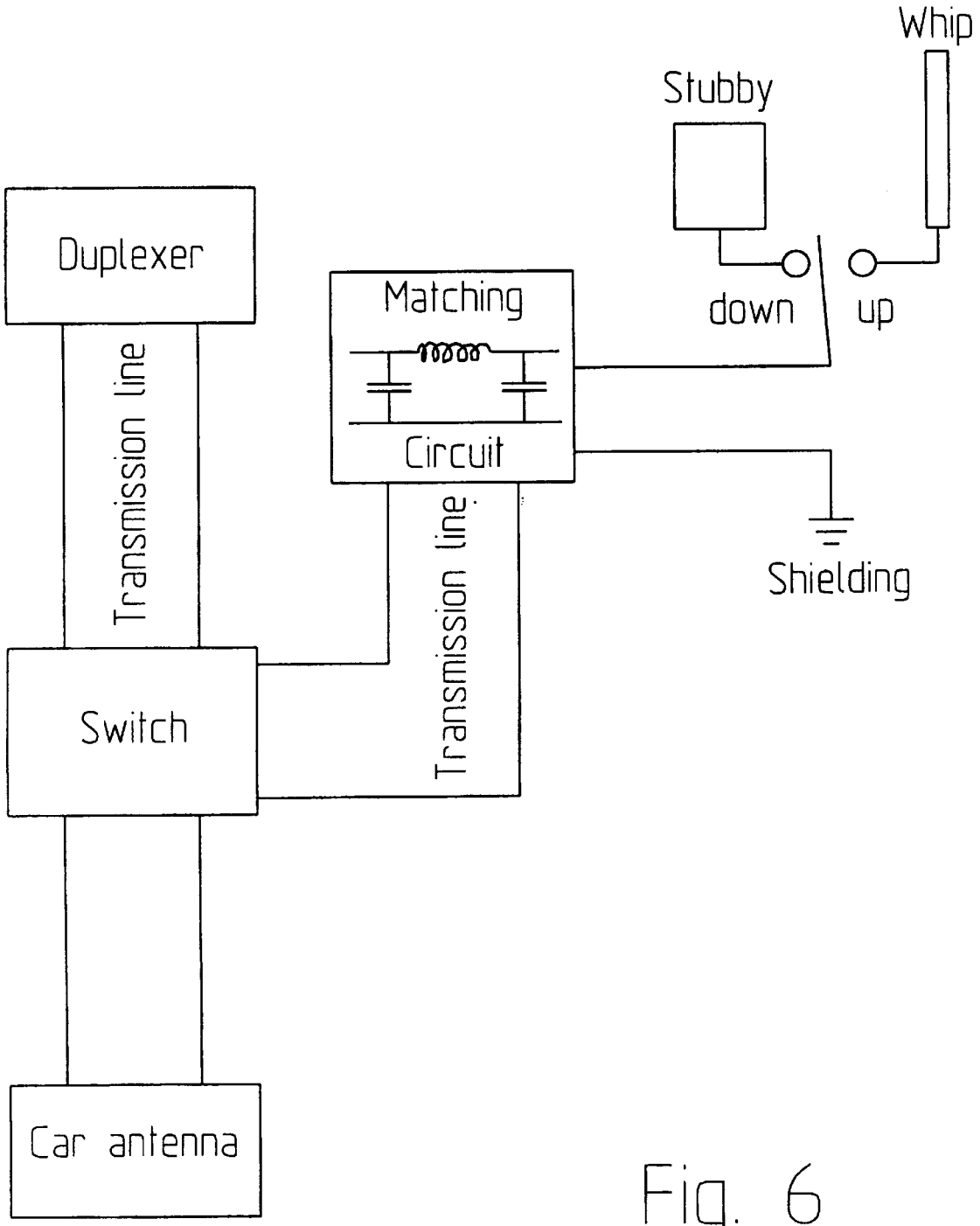
FIG. 6 shows a prior art arrangement for a system including mobile telephone circuitry etc.

FIG. 6 shows an overview of a prior art antenna system seen from the duplexer of a telephone. The system includes switches, a matching circuit, a shielding, two radiators, and a car antenna.

Figure 7:
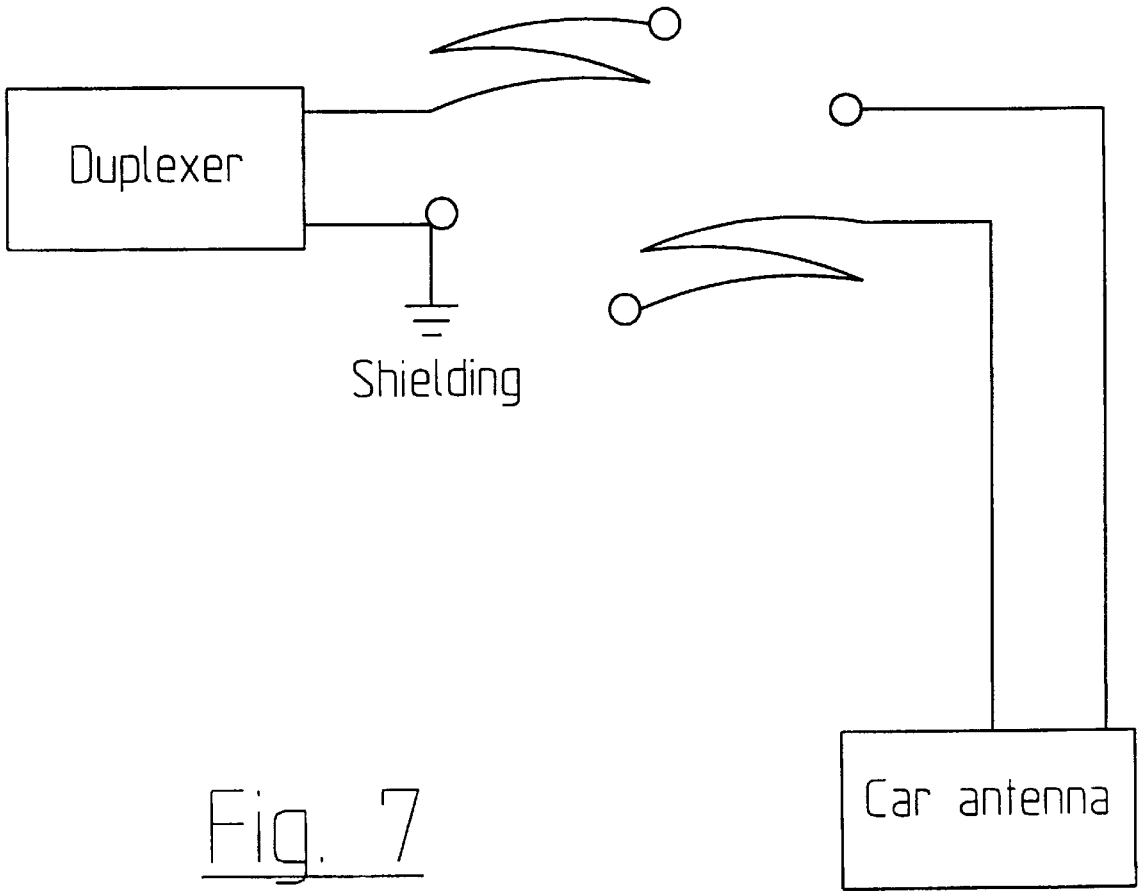
FIG. 7 shows a system of the invention to be compared to that of FIG. 6.

FIG. 7 shows how the system of FIG. 6 is simplified through the invention. The depicted inventive system includes a duplexer, a shielding, internal and external zigzag elements, connection points, and a car antenna.

Figure 8:
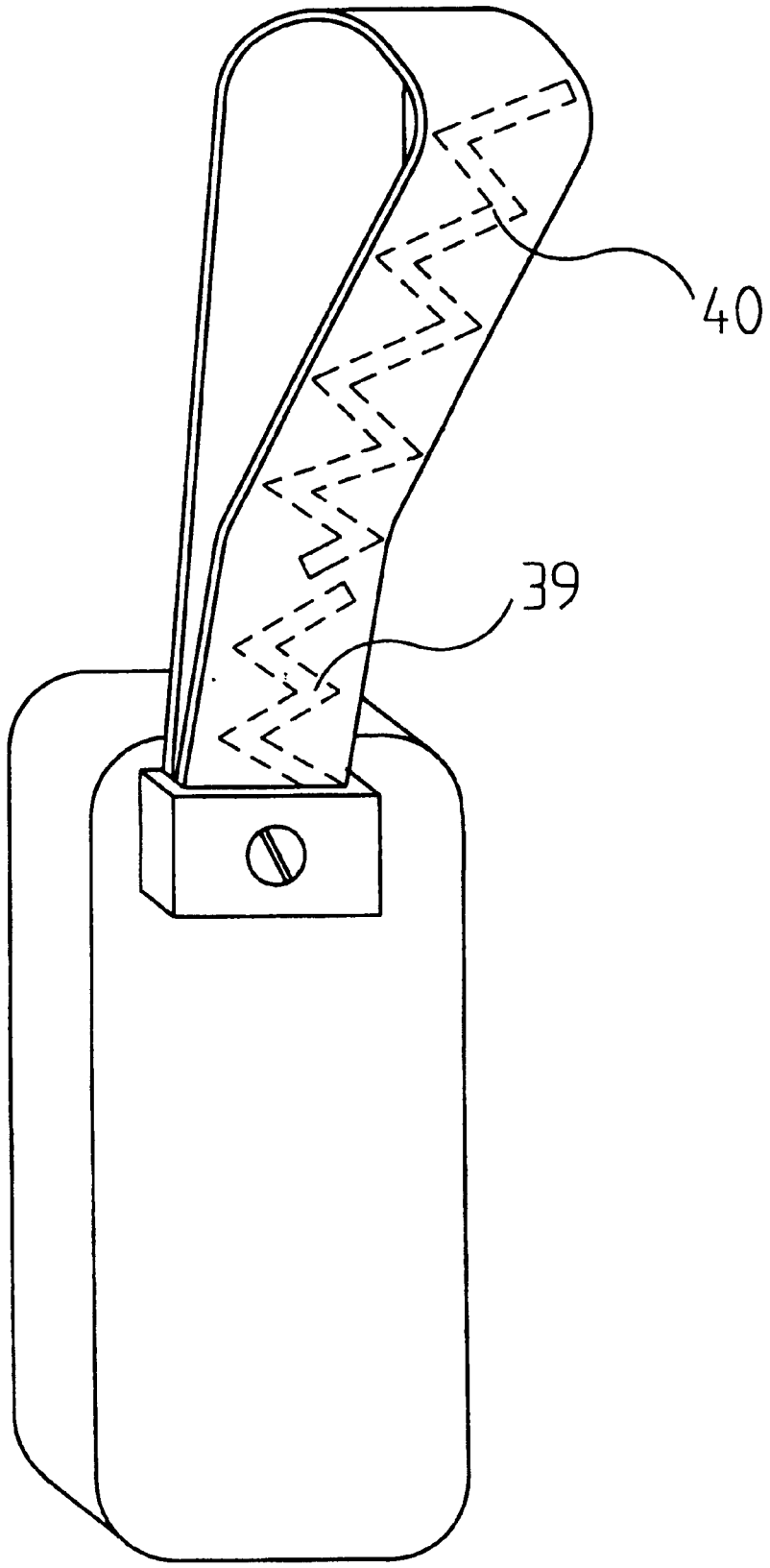
FIG. 8 shows an embodiment of the antenna means according to the invention, wherein the antenna means is arranged in the carrying strap of a hand portable telephone.

FIG. 8 shows an embodiment wherein a carrying loop contains two antenna parts. The first antenna part 39 is galvanically connected to the electrical elements such as the Duplexer, Receiver and/or Transmitter inside of the phone. The second antenna part 40 is capacitively coupled to first antenna part 39 with a gap less than ten percent of the wavelength For which the antenna is designed. In the preferred embodiment the gap is very small so that the coupling is stronger and therefore the current amplitude in the second antenna part 40 is greater. The coupling can take place in an end-to-end arrangement (as is shown in FIG. 8) or in an overlapping arrangement where part 39 and part 40 overlap each other for some or all of the length of part 39. The second antenna part 40 has approximately an electrical length of half a wavelength of the wanted frequency. The current amplitude in the second antenna part 40 is highly responsible for the gain of the antenna because it is half a wavelength long and therefore electrically longer than the first antenna part 39. Preferably, the first antenna part 39 has an electrical wavelength of approximately a quarter of the wavelength of the wanted frequency.

Figure 9:
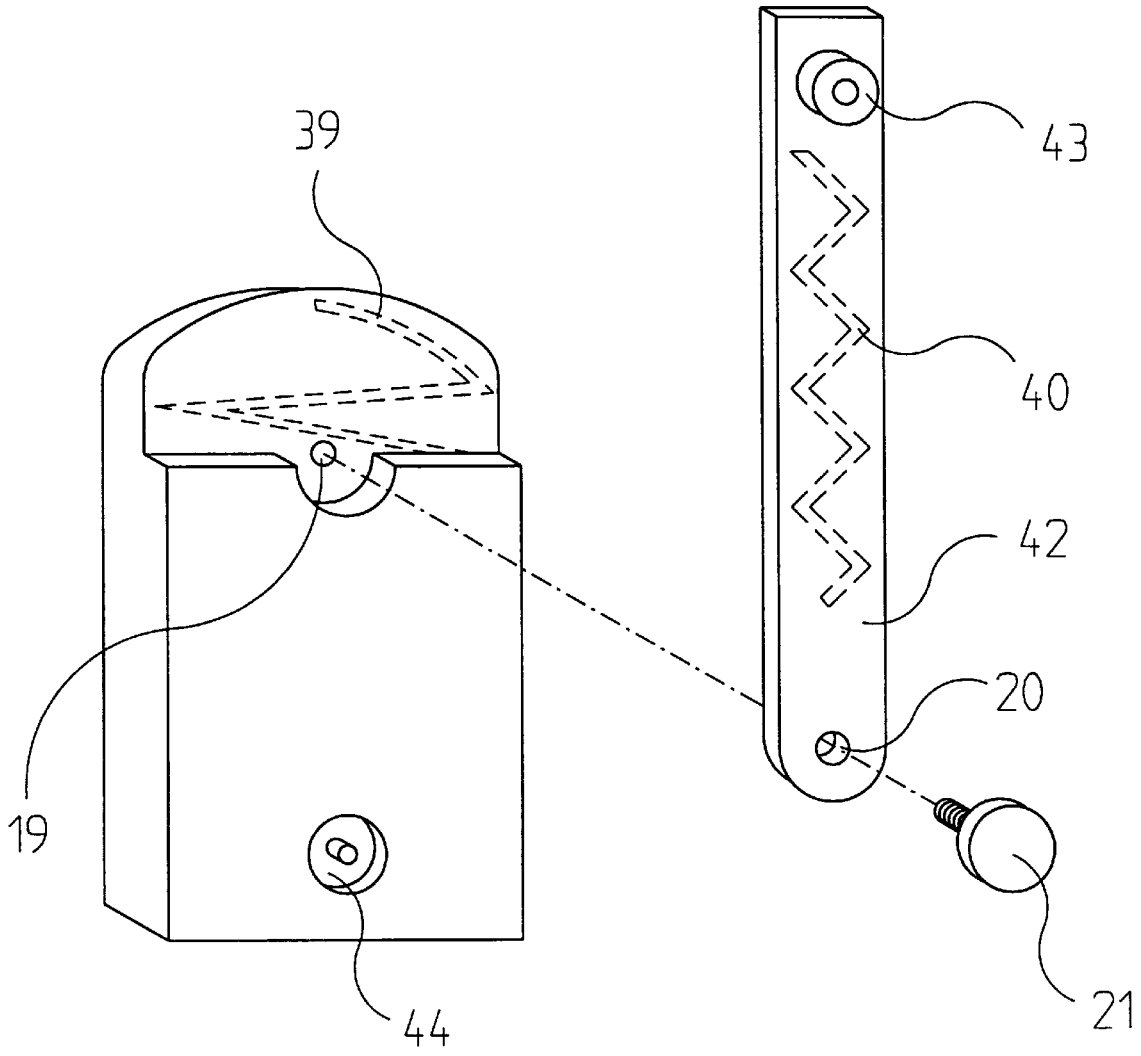
FIG. 9 shows another embodiment of the antenna means according to the invention, wherein the antenna means is arranged inside a chassis of a hand portable telephone and in detachable part thereof.

FIG. 9 shows the back of a phone or a similar transmitting and/or receiving device. Electrically, this embodiment (with the antenna in the "up" position) is the same as the device described in FIG. 8 with two capacitively coupled antenna parts (39, 40 FIG. 8). The first antenna part 39 is now contained within the housing of the phone. This part is of a zigzag shape. The second antenna part 40 is located inside the antenna strap 42. The second antenna part 40 can be a zigzag shape, a helical, a rectangel were length>width>thickness, or a cylinder. The choice of shapes is dependent on the amount of space that can be used, the bandwidth desired and the frequency range that the antenna is designed to receive and transmit. The strap 42 can be made out of the same materials already mentioned in the section dealing with FIG. 7. The first antenna part 39 can be made out of conductive foil, conductive metal or wire, conductive paint etc.

The two antenna parts are capacitively coupled. Therefore no galvanic connection through the case of the transmit/receive device is needed (in this embodiment the device is the phone). That means that it is easy to make the antenna assembly and connector waterproof because no direct electric galvanic connection is needed through the case. Two positions of the antenna strap 42 are possible with this embodiment. The up-position as shown exploded in FIG. 9 and the down position. In the down position the strap is folded down and snapped into the phone. The snap mechanism 43, 44 can be provided with regular clothing snaps, or any other snap hook device, hook and loop fastener, etc. The strap 42 and snap 43, 44 can be made strong enough so that the antenna provides the user with another function such as a grip, belt loop, handle etc. In this embodiment the antenna strap has a hole 20 near its base through which retention screw 21 passes and is threaded into blind attachment hole 19.

Figure 10:
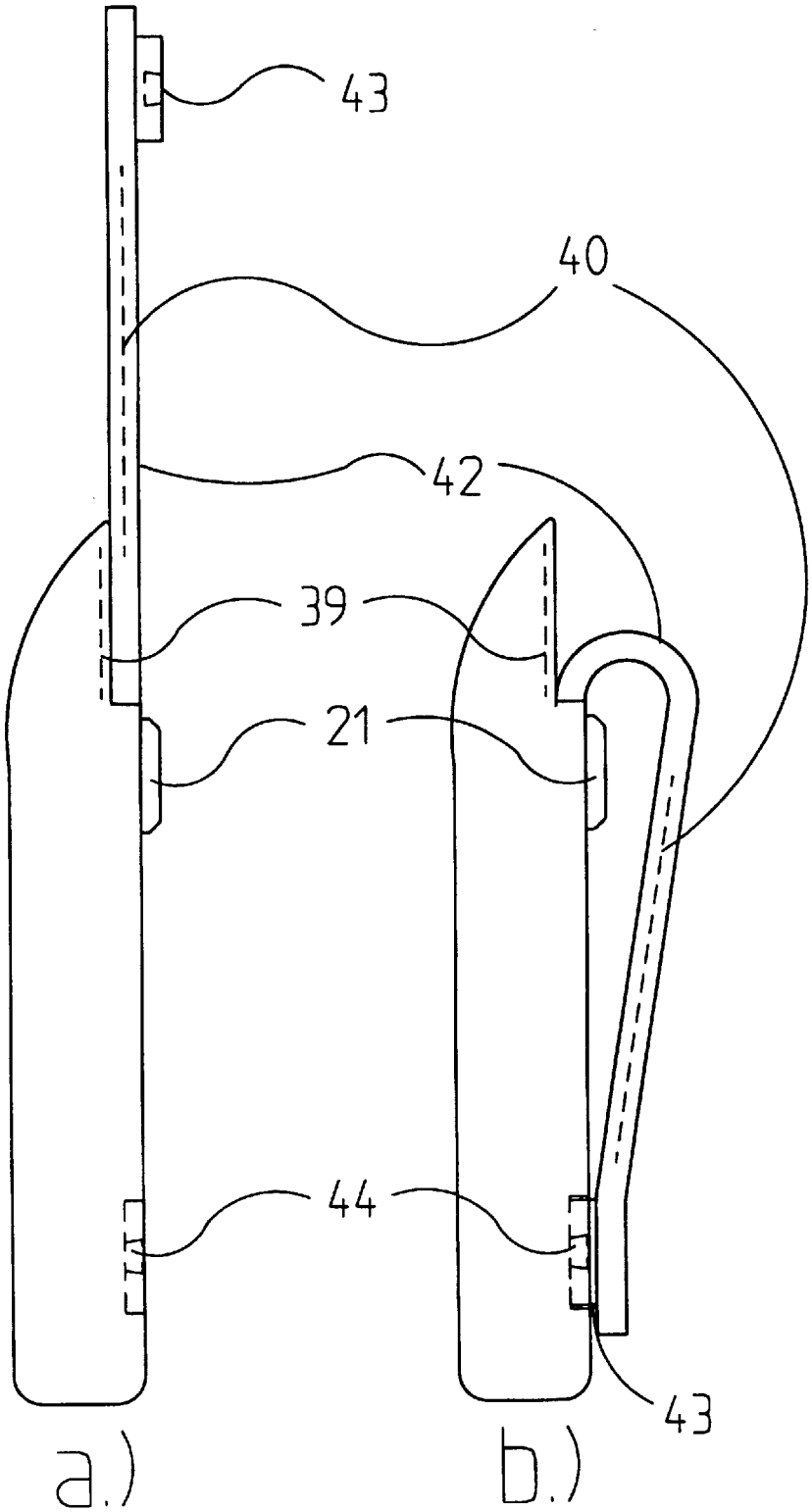
FIG. 10 shows another embodiment of the antenna means according to the invention, wherein the antenna means is arranged inside a chassis of a hand portable telephone and in a bendable and erectable tart attached thereto.

FIG. 10 shows two different cross sectional side views of a phone similar to the phone in FIG. 9. The dashed lines 39, 40 are representing the two antenna parts. The first antenna part 39, which is inside the case can be made out of electrically conductive foil, can be painted with conductive paint onto the inside of the case of the phone, can be plated onto the case, can be part of the printed circuit board, etc. FIG. 10*a* shows the up position and FIG. 10*b* the down position of the antenna strap 42. In the down position (10*b*) the strap 42 is folded down so that second antenna part 40 is only marginally coupled to first antenna part 39, but capacitively coupled to the shielding. In this case the antenna assembly (39 and 40) works more like a quarter wave length zigzag antenna. In an alternate embodiment it is also possible to connect second antenna part 40 with a galvanic connection to the shielding at snap 43, 44 so that the second antenna part acts as an additional ground plane.

Figure 11:
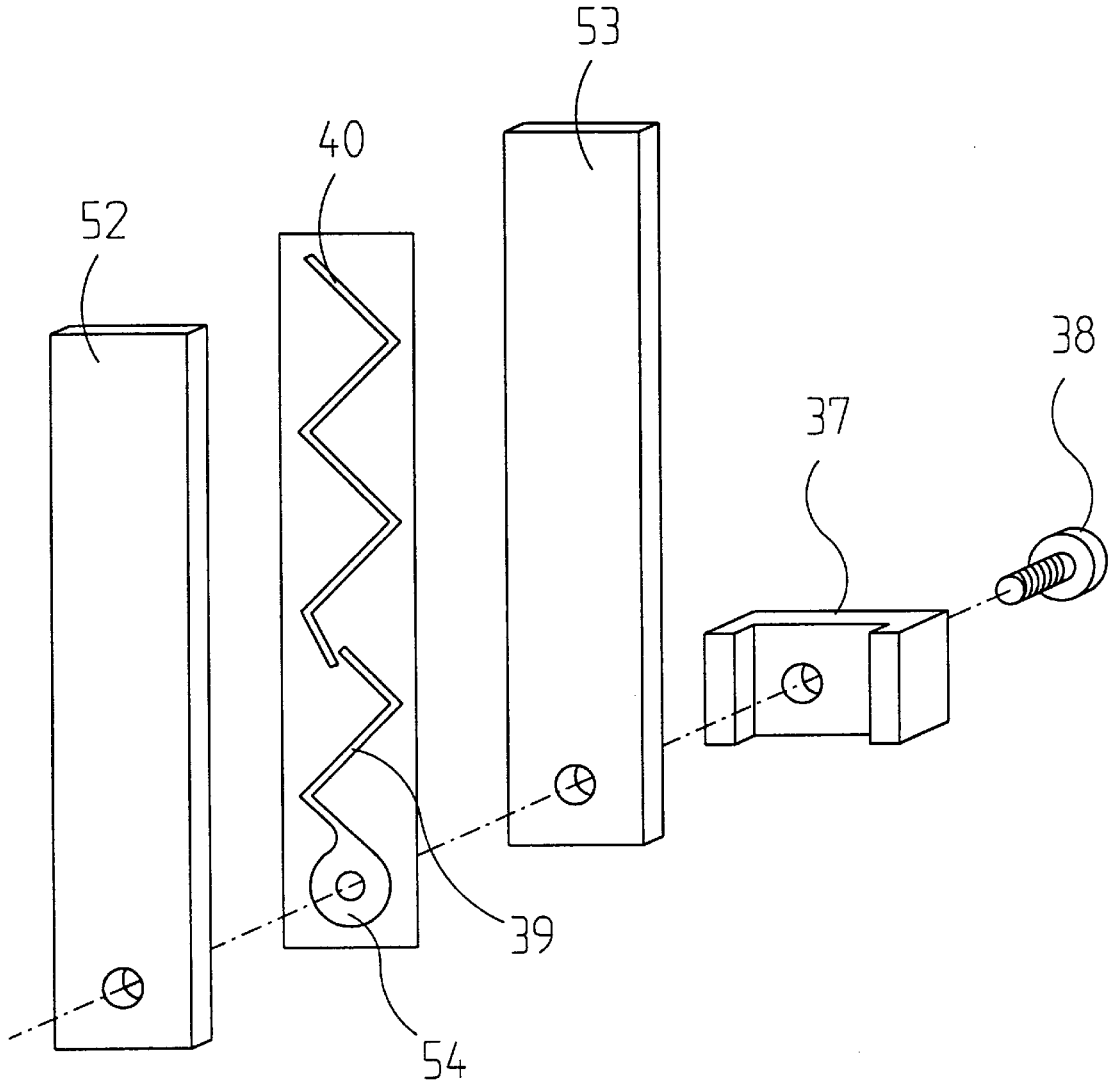
FIG. 11 shows an exploded view of another embodiment of the antenna means according to the invention, wherein the antenna means is intended for mechanically and electrically connection externally on a telephone chassis.

FIG. 11 shows an exploded antenna assembly where the first antenna part 39 and the second antenna part 40 are inside two flexible parts 52, 53. These flexible parts can be sheets or extrusions of a plastic substance (e.g. polyurethane, sanoprene), a composite of a scrim and a plastic substance (e.g. Nylon cloth laminated to polyurethane), or any other flexible and strong material which is suitable for the manufacture of antenna exteriors. When flexible parts 52, 53 contain polyurethane or their contacting surfaces, they can be welded together in various ways such as Ray welding, heat welding, Ultrasonic welding etc. These flexible parts can also be glued or sewn together. In an alternate construction (not shown) the two flexible parts 52, 53 can be made from single folded sheet which is folded so as to cover and protect antenna parts 39, 40. The conductive antenna elements 39, 40 are covered with the flexible parts 52, 53 which are joined together. In this embodiment the first antenna part 39 provides a contact 54 at its bottom end which has enough surface for a galvanic connection with a screw 38 or a screw washer (not shown in the drawing). The screw attaches the antenna assembly (39, 40, 52, 53, 54) to the case of the device (not shown) and provides the electrical connection to the Transmitting/Receiving elements inside the phone. In this embodiment a retainer 37 helps to hold the antenna in its place. In an alternate embodiment (not shown) flexible parts 52, 53 can be replaced by suspending antenna parts 39, 40 in a non-conductive mesh (fiberglass, plastic, etc.), and overmolding the parts and the mesh with a plastic material (e.g. overmolding using two part room temperature polyurethane). This mesh suspends the parts 39, 40 between the outside surfaces of the plastic material and acts as a scrim to prevent the plastic material room overstretching. This mesh/overmolding assembly method eliminates the need for two separate flexible parts 52, 53 and eliminates the bonding, gluing, welding, or sewing process normally needed to join them (52, 53) together.

Figure 12:
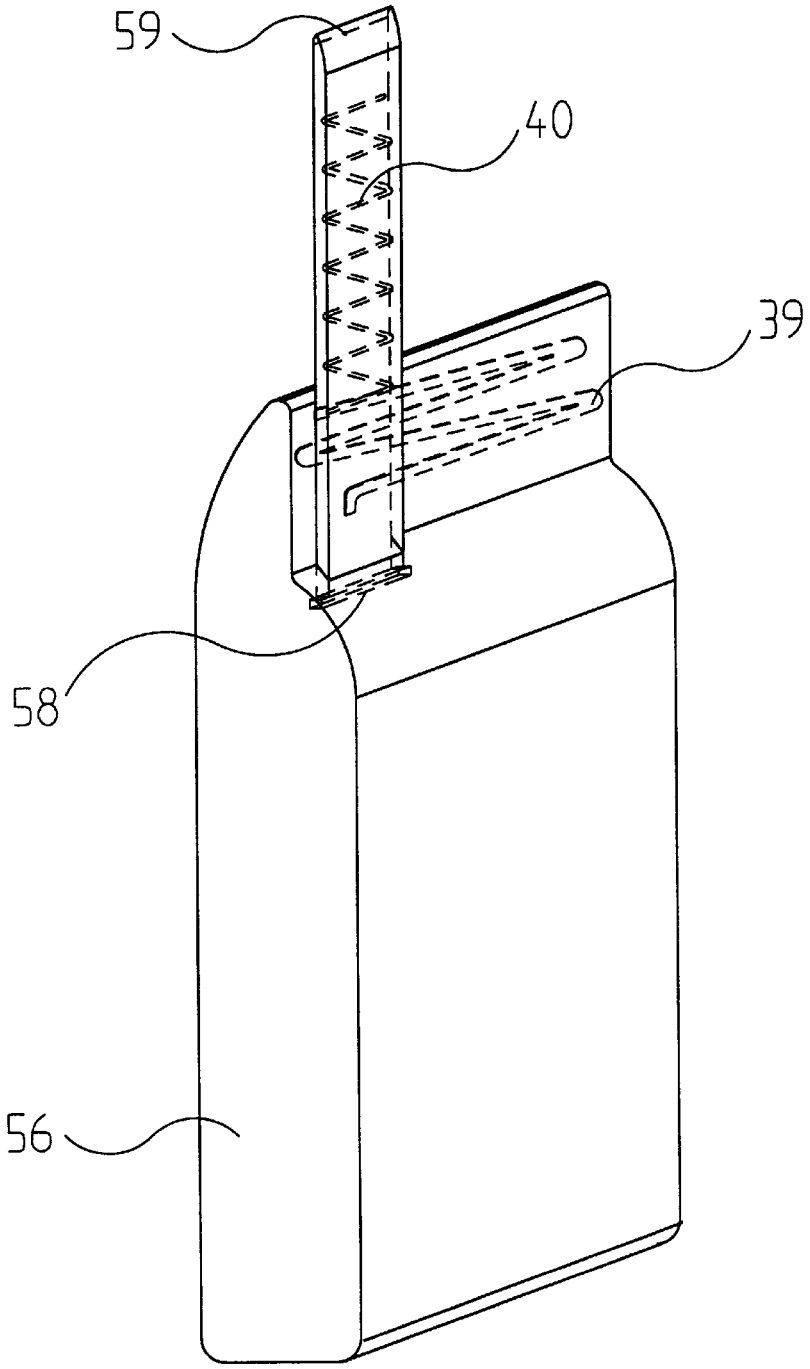
FIG. 12 shows, in an extended position, another embodiment of the antenna means according to the invention, wherein the antenna means is comprised by a combination of an extendable/retractable element and an element fixed to a telephone.

FIG. 12 shows a phone 56 (which can also represent a computer, a pager, or any other transmitter and/or receiver device) with an capacitively coupled antenna assembly. The first antenna part 39 is electrically connected to the Dulexer, or Transmitting and/or Receiving device. The second antenna part 40 is mounted on a manner which allows it to be extended and retracted into and out of phone case 56. In the extended or "up" position the bottom end of antenna part 40 is higher than the lowest part of the first antenna part 39, which is located inside the case of the phone 56. The nonconductive flexible or semi-flexible covering material 59 can be made of plastic such as polyurethane or out of a composite which includes a scrim and a plastic (e.g. the overmolding described in FIG. 11). At the lower end of covering material 59 there can be located an antenna stop 58. This device keeps the antenna from being withdrawn completely out of the case and can provide indexing to help retain the antenna in the fully extended and/or fully retracted positions. Stop 58 can be integrally molded into covering material 59 or can be affixed by some other commonly used means.

Figure 13:
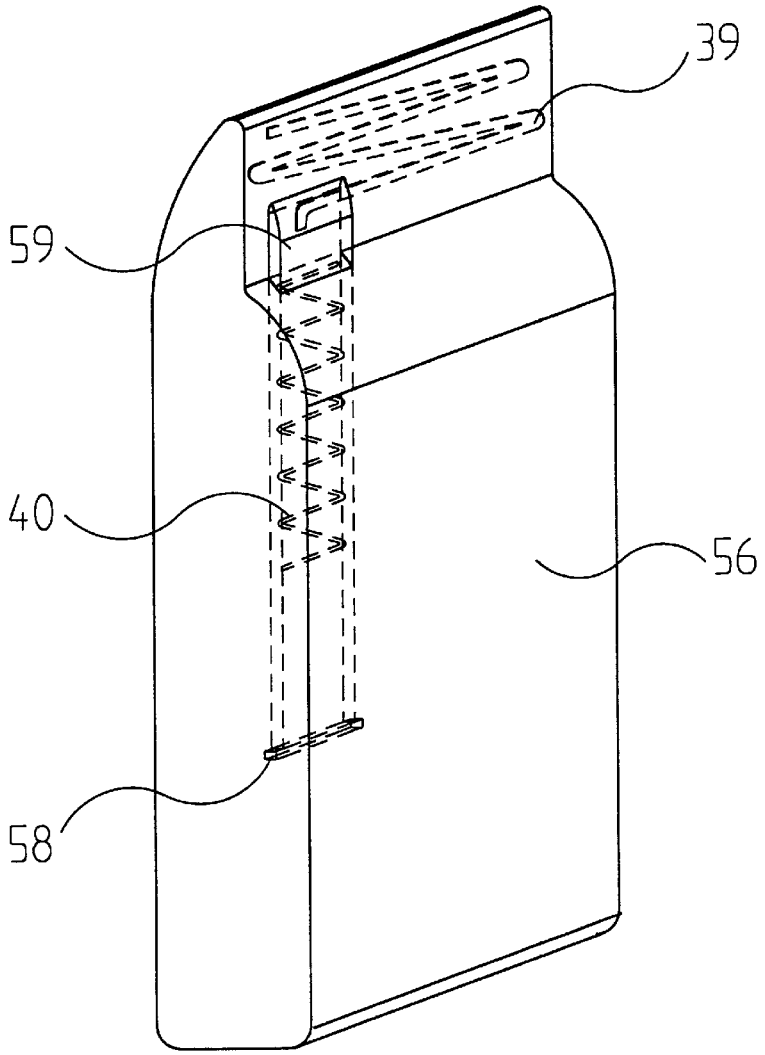
FIG. 13 shows, in a retracted position, another embodiment of the antenna means according to the invention, wherein the antenna means is comprised by a combination of an extendable/retractable element and an element fixed to a telephone.

FIG. 13 shows a phone which is similar to the phone in FIG. 12 but shows the retractable antenna assembly (40, 58, 59) in the retracted position. Antenna assembly (40, 58, 59) is said into the case (or in another embodiment, to a point along side of the case (not shown)). The upper end of 40 can be lower than the bottom point of the first antenna part 39, so at the two antenna parts are decoupled. In another embodiment (not shown) part 40 can be higher than the bottom point of the first antenna part 39 so that the two antenna parts (39, 40) are in a parallel position, which means that part 40 is capacitively coupled to the shielding of the phone and to the first antenna part 39.

Figure 14:
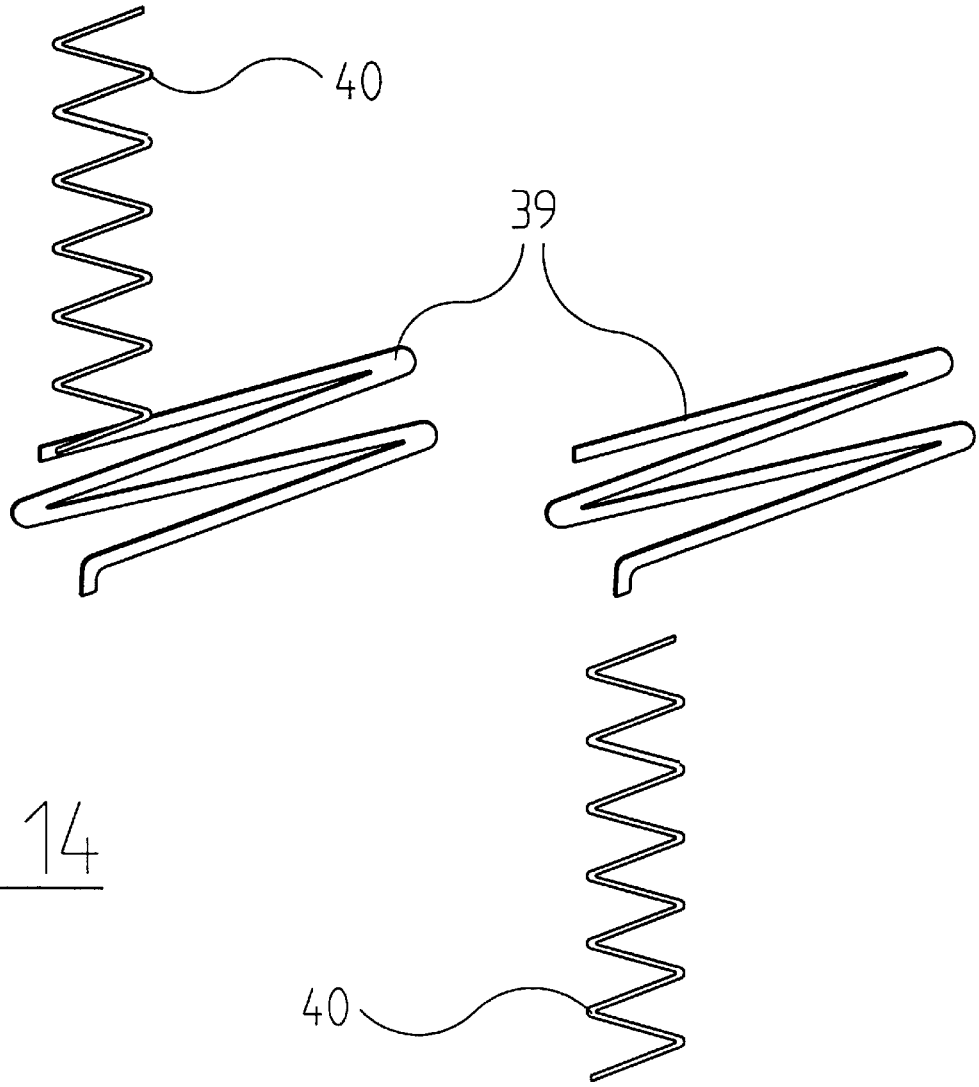
FIG. 14 shows the elements of FIGS. 12–13 in the extended and retracted positions, respectively.

FIG. 14 shows the first (39) and the second (40) antenna parts which were shown in FIG. 12 and FIG. 13. Where FIG. 14*a*) shows an embodiment of the up position and FIG. 14*b*) shows an embodiment of the down position.

Figure 15:
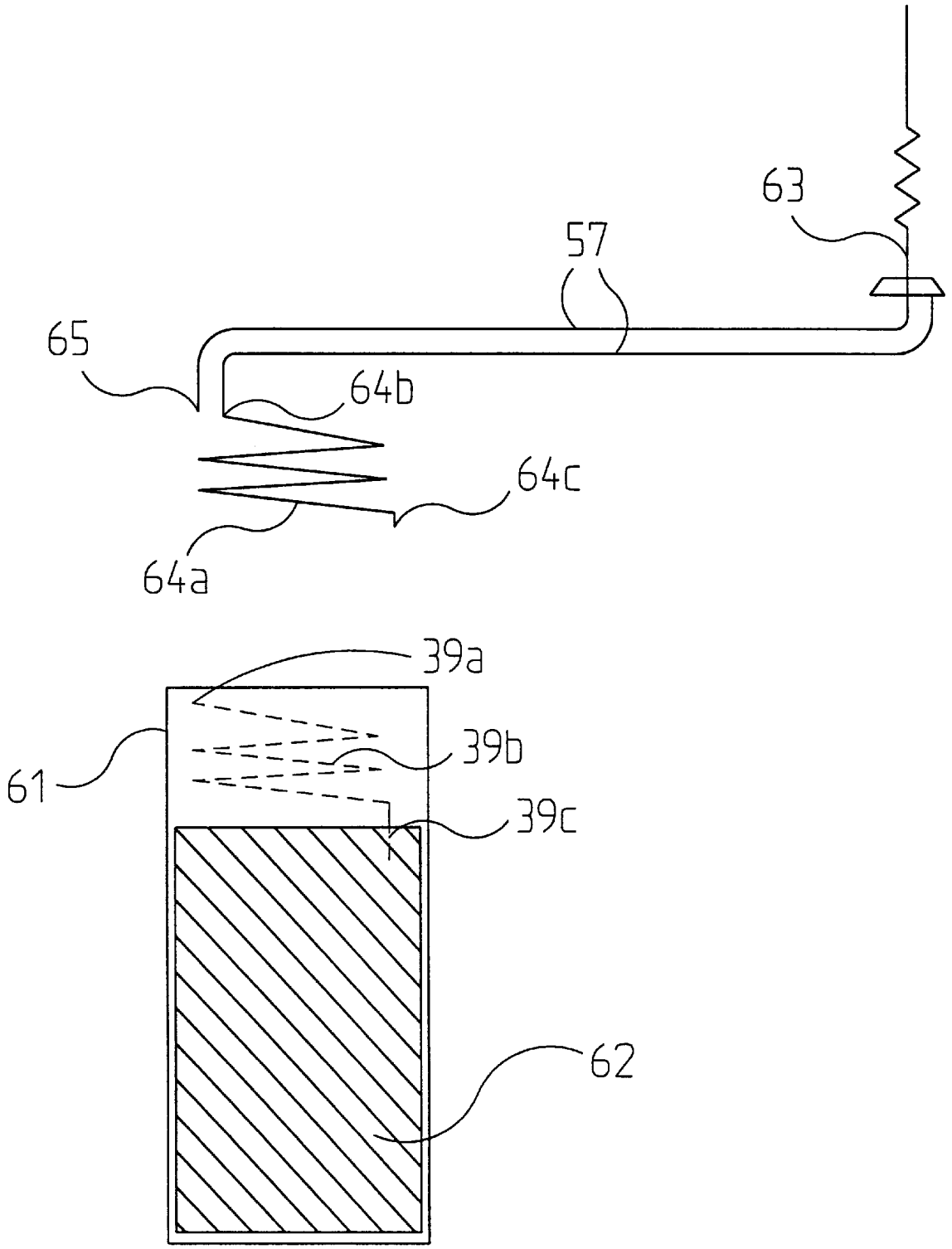
FIG. 15 an arrangement according to the invention, wherein an antenna element, such a the fixed element of FIGS. 12–14, is combined with a connecting means for enabling the telephone that carries the antenna element to be connected to an auxiliary antenna via a transmission line.

FIG. 15 shows an electronic communication device 61 such as a mobile phone with a first antenna part (39*a*, 39*b*, and 39*c*). An external device (e.g. a car antenna 63) can be plugged onto device 61, and the existing antenna (39*a*, 39*b*, and 39*c*), will be automatically switched off. The bottom portion or first antenna part 39*c* is connected to the duplexer, or transmitting and/or receiving circuit(s). A conductive zigzag (64*a*, 64*b*, and 64*c*) is connected to one end of one conductor of the transmission line 57 (at 64*b*). On the same end, the other conductor of transmission line 57 is connected to galvanic connector 65. Transmission line 57 can be a coaxial transmission line, or a shielded parallel transmission line. When zigzag plug (65, 64*a*, 64*b* and, 64*c*) is plugged onto the upper region of the device 61, two galvanic connections are completed. The first is galvanic connector 65 makes galvanic contact with the top portion 39*a* of first antenna part (39*a*, 39*b*, and 39*c*). The second galvanic connection is from the bottom portion (64*c*) of zigzag plug (64*a*, 64*b*, 64*c*, 65) to the ground/shielding 62. The first antenna part is now no longer an antenna but functions as part of a parallel transmission line. The distance between the zigzag plug and the first antenna part and the dielectric constant of the material(s) between the two parts should be calculated using standard antenna handbook transmission line formulas so that the parallel transmission line possesses the desired transmission line resistance characteristics (e.g. 50 ohms). If, in a particular application, interference is a problem the zigzag plug can be shielded with conductive material, which electrically is analogous to a parallel shielded transmission line.

Figure 16A:
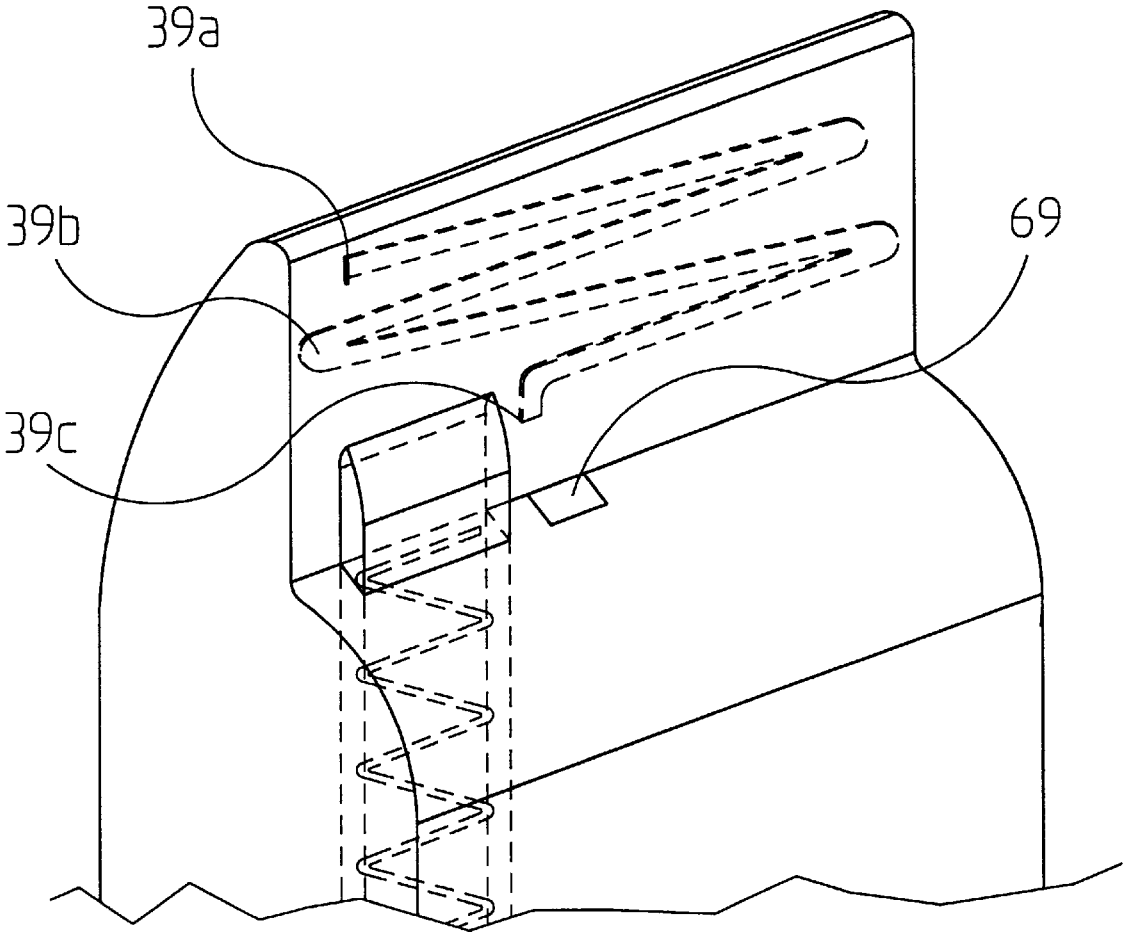
FIGS. 16*a,* 16*b,* and 17 show details of an embodiment of the arrangement in FIG. 15, wherein an extendable/retractable antenna element is included.

FIG. 16*a* shows the upper part of a phone from FIG. 13 with modifications to allow the antenna to automatically switch into a parallel transmission line when zigzag plug (64*a*, 64*b*, 64*c*, and 65) is placed onto the phone. The dotted lines are showing the internal first antenna part (39*b* and 39*c*). At 39*a* the internal first antenna part makes galvanic connection through to the exterior of the phone. This is necessary to implement the first galvanic connection described in FIG. 15. The galvanic ground/shielding contact 69 allows the implementation of the second galvanic connection described in FIG. 15. Contact 69 is galvanically connected to the ground/shielding of the phone and makes contact with the bottom portion 64*c* of the zigzag plug described in FIG. 15.

Figure 16B:
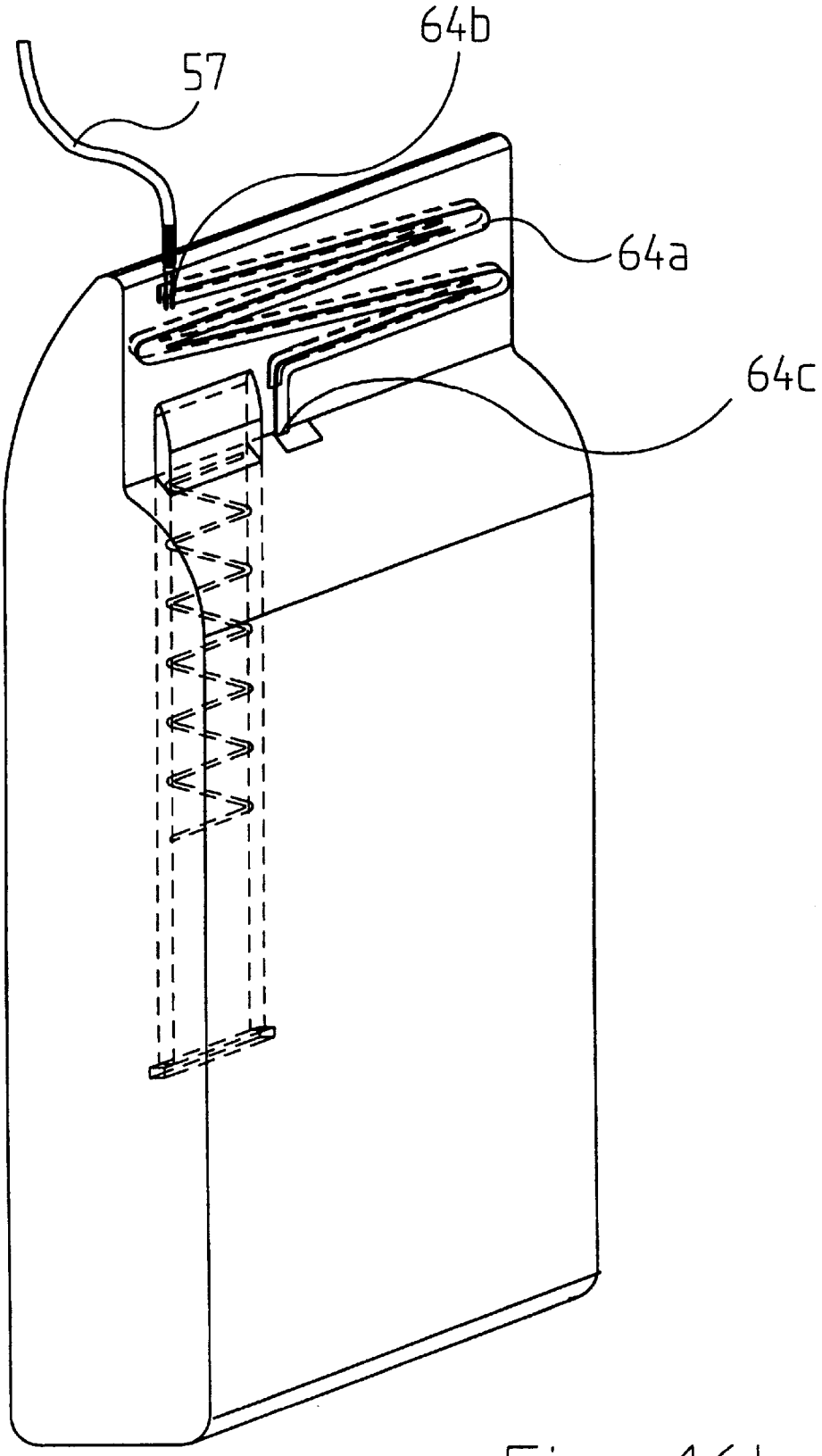

FIG. 16*b* shows the phone from FIG. 16*a* with an embodiment of the zigzag plug (64*a*, 64*b*, 64*c*, and 65) and transmission line 57 described in FIG. 15. The first antenna part (39*a*, 39*b*, and 39*c*—FIG. 16*a*) is switched off and is acting as part of a parallel transmission line.

Figure 17:
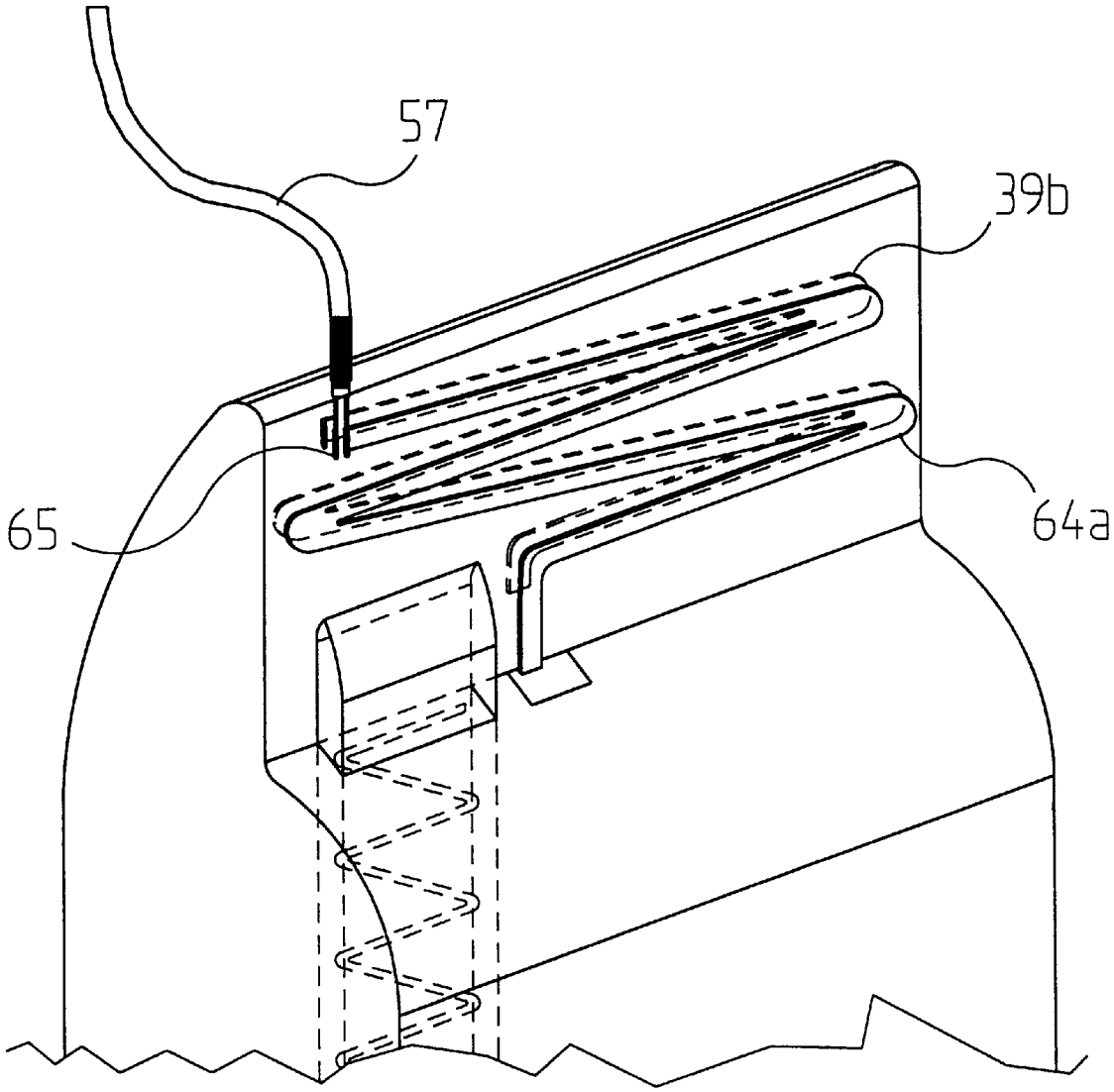

FIG. 17 is an enlarged view of FIG. 16*b* and shows the phone, the antenna, the transmission line, and the zigzag-plug in the "plugged in" position according to figure 16*a*, FIG. 16*b*, FIG. 15 and FIG. 14.

Figure 18:
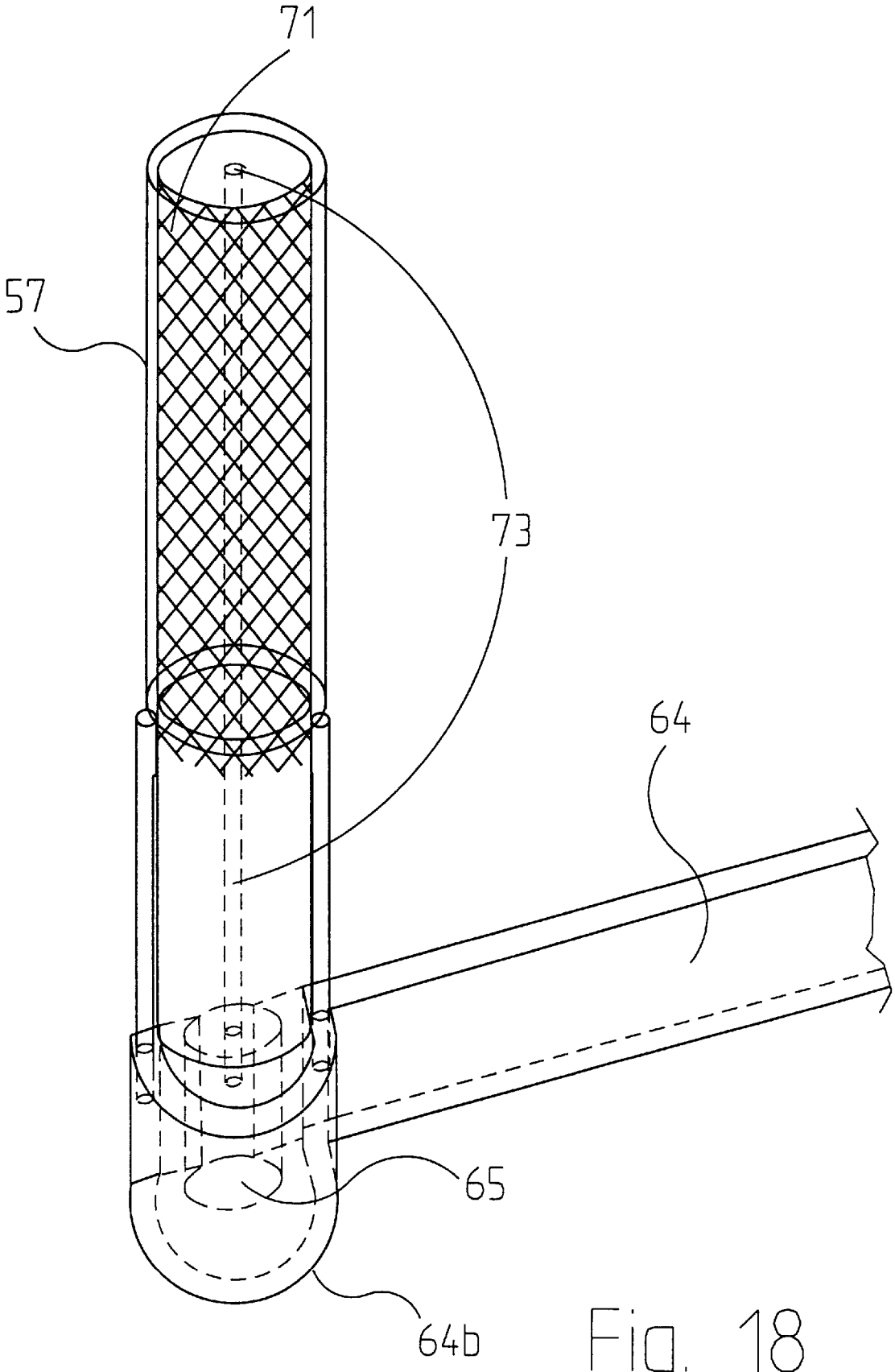
FIG. 18 shows even closer details of the embodiment of FIGS. 16*a,* 16*b,* and 17.

FIG. 18 shows the end of the transmission line 57 that enters the zigzag plug (64*a*, 64*b*, and 65), the galvanic connector 65, and the beginning of the conductive zigzag, all in a bigger scale and n an alternate embodiment from what was already shown in FIG. 17. One conductor 71 (in this embodiment the braid on a coaxial transmission line) in the Transmission line 57 is connected with the conductive zigzag plug (64*a*, 64*b*, and 64*c*). The other conductor 73 (in this embodiment the center conductor of a coaxial transmission line) in the transmission line 57 is connected to the galvanic connector 65. The galvanic connector 65 provides the connection with the exposed top portion 39*a* of the internal first antenna part, shown in FIG. 16*a*.

Figure 19:
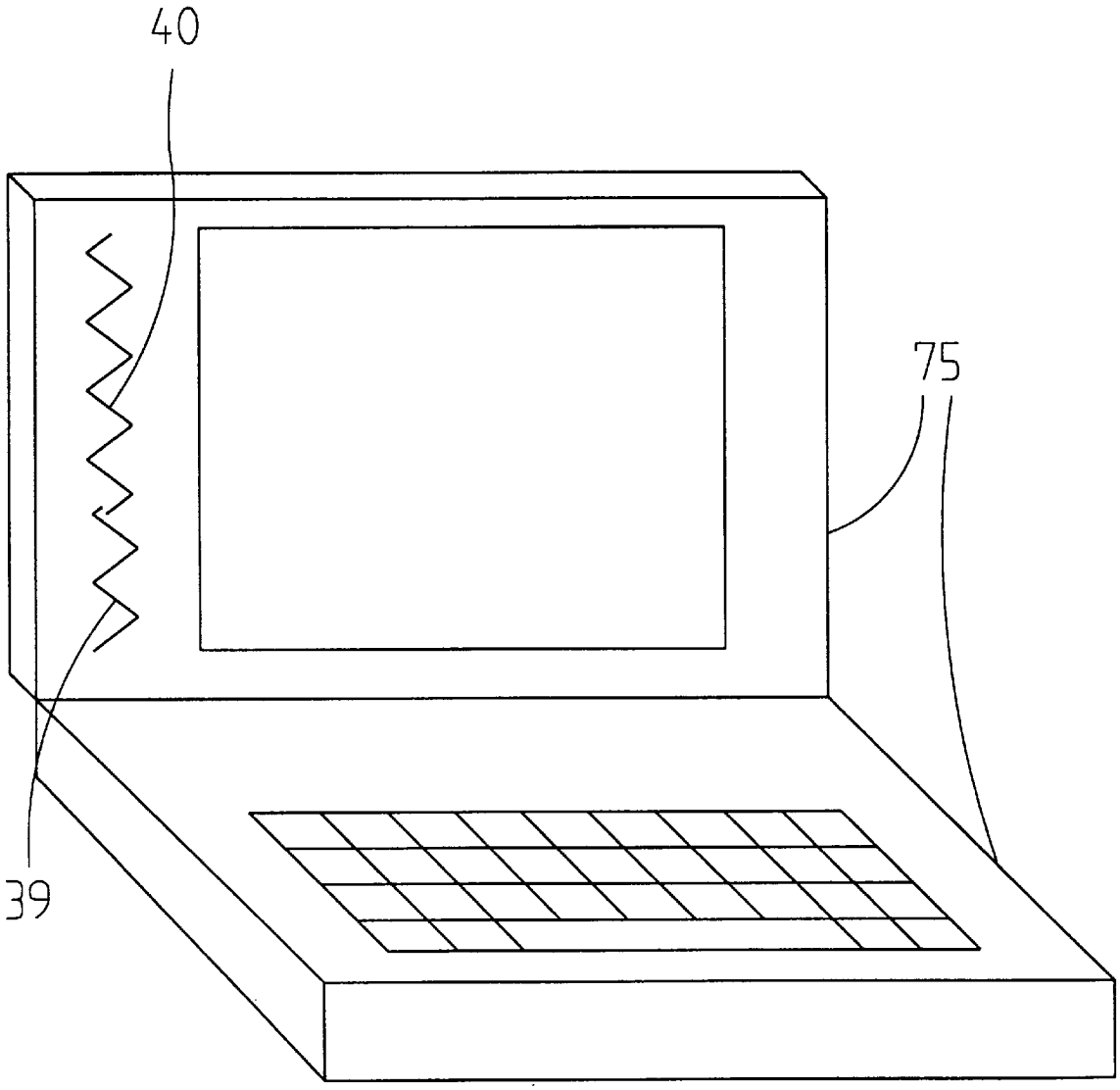
FIG. 19 shows another embodiment of the invention wherein the antenna means is integrated in a top part of a foldable laptop computer having a radio communication function.

FIG. 19 shows a portable computer, laptop, notebook or a similar device 75. The bottom point of 39 is connected with a transmission line which provides the connection to the Receiving/Transmitting, Duplexer device inside 75. A second antenna part 40 is capacitively coupled to the first antenna part 39. If there is no matching circuit provided inside 75, then the electrical length of the first antenna part 39 is approximately a quarter wavelength and the electrical length of the second part 40 is approximately half a wavelength. Because there is no need to flex marts 39 and 40 a conductive paint can be substituted for foil or wire in some applications.

Figure 20:
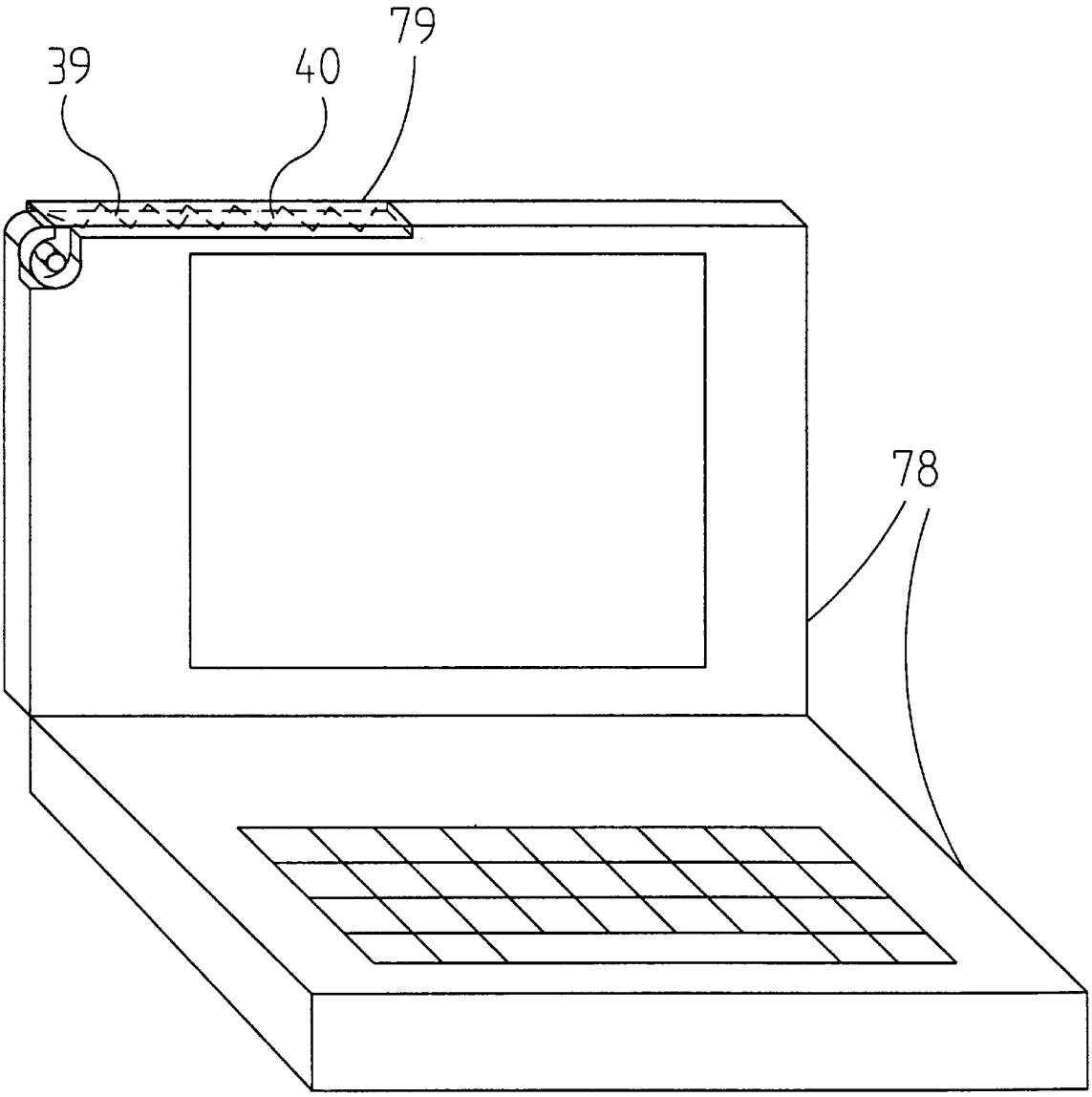
FIG. 20–22 show another embodiment of the invention wherein the antenna means is foldably connected to a top part of a foldable laptop computer having a radio communication function.

FIG. 20 shows a computer, notebook or similar communication device 78. At a top corner of the electronic device 78 is a foldable part 79 shown folded down and horizontal. This foldable part has first antenna part 39 and second antenna part 40 contained within it. The left hand end of 39 is connected with a transmission line which provides the connection to the Receiving/Transmitting, Duplexer device inside 78.

Figure 21:
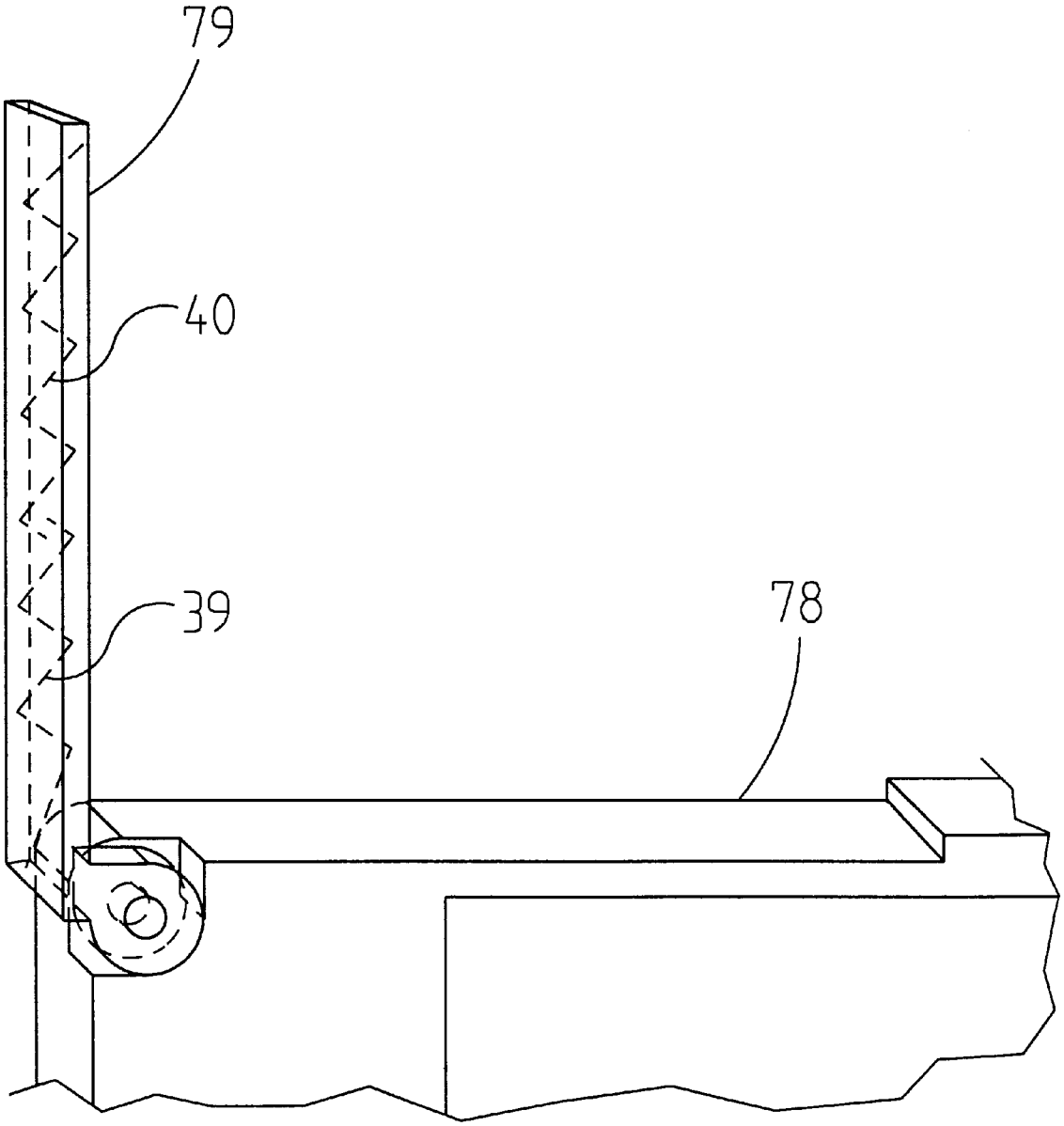

FIG. 21 shows the ton left corner of the device 78 shown in FIG. 20.

Figure 22:
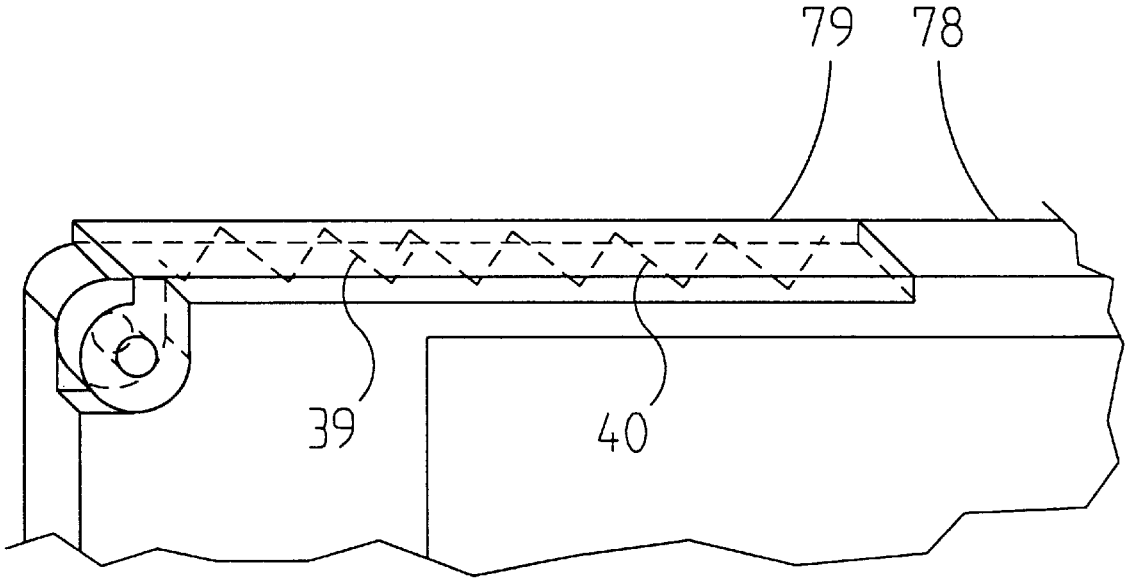

FIG. 22 shows the same embodiment as FIG. 21 but in the folded down position.

Figure 23:
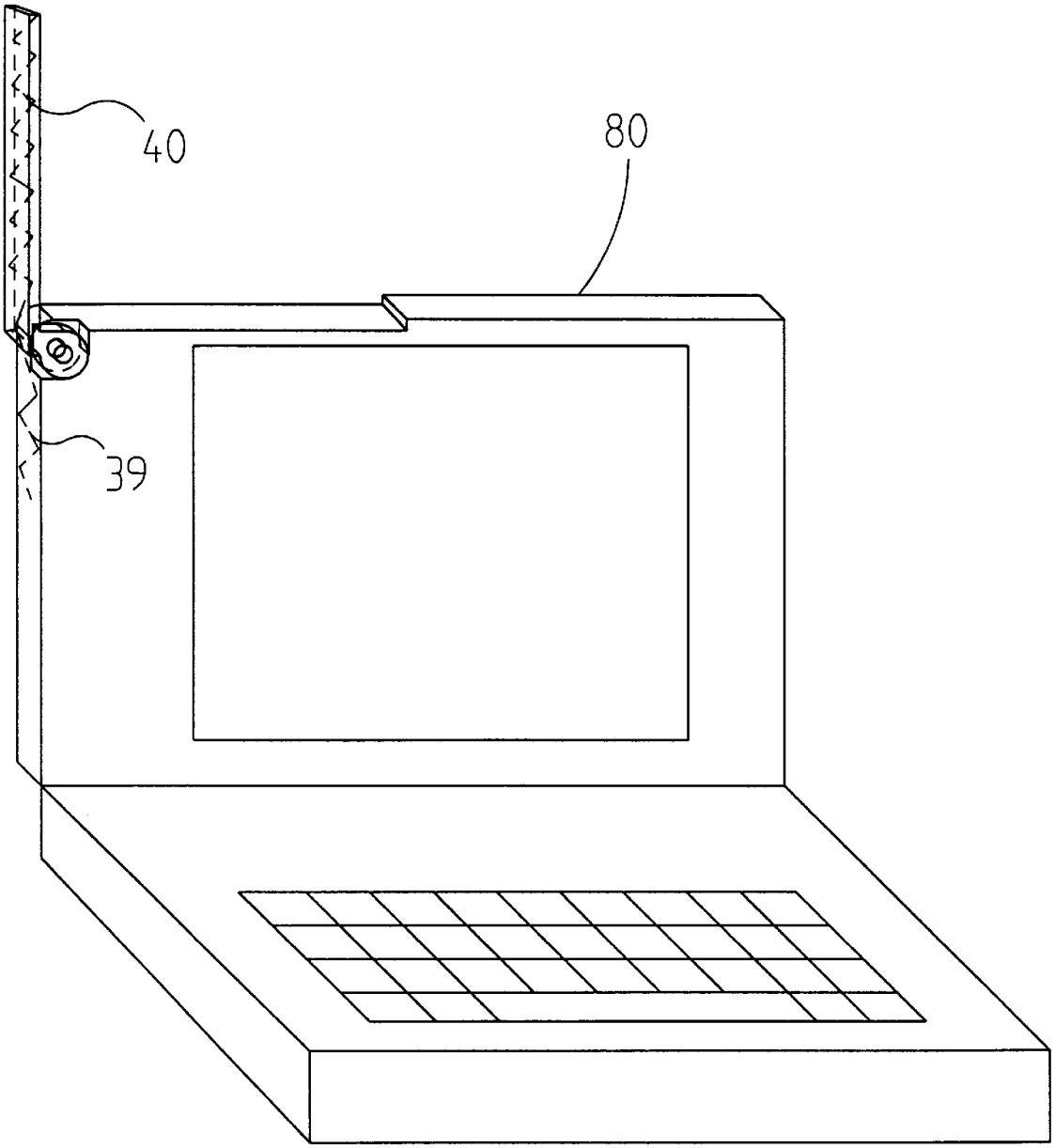
FIG. 23–24 show another embodiment of the invention wherein the antenna means is partly foldably connected to, partly integrated in, a top part of a foldable laptop computer having a radio communication function.

FIG. 23 shows an alternative embodiment of the device in FIG. 20. The first antenna part 3 is located inside the device 80. The second antenna part 40 is mounted inside of the foldable part 79 on the case of 80 and is capacitively coupled to the first antenna part 39 when the foldable part 79 is in its vertical position.

Figure 24:
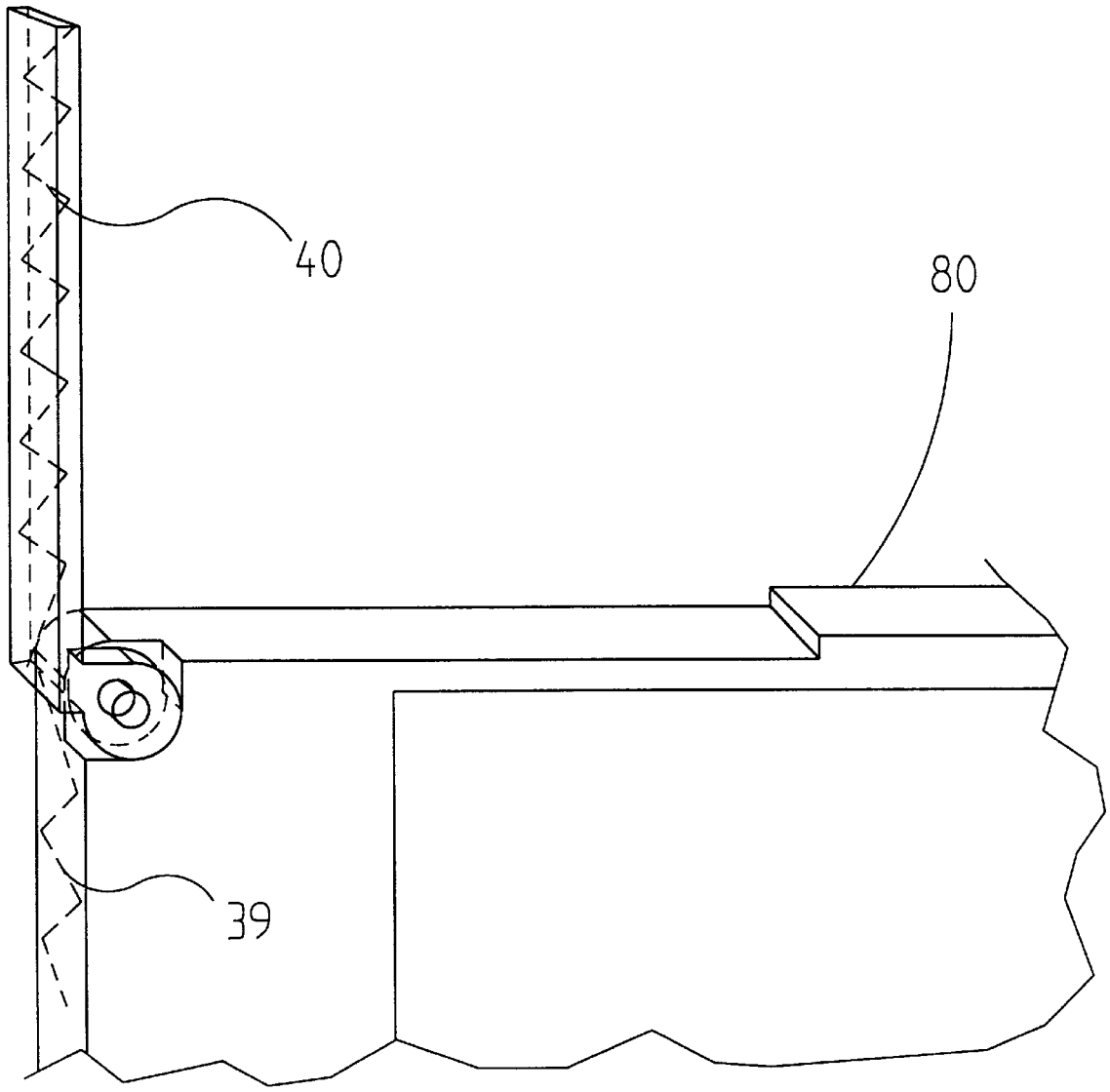

FIG. 24 shows an enlarged view of the antenna area of FIG. 23.

Figure 25:
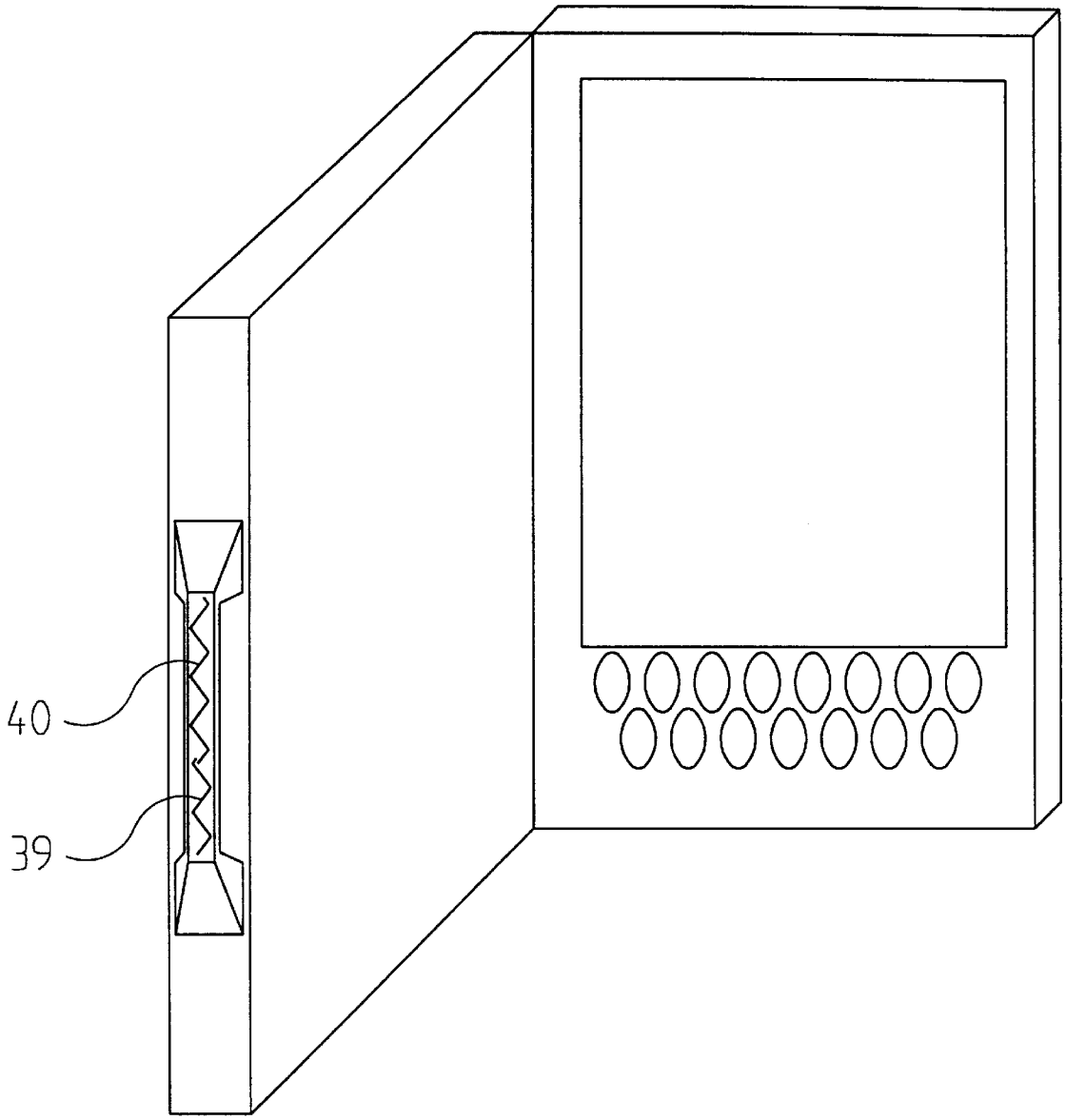
FIG. 25 shows another embodiment of an antenna means according to the invention similar to that of FIG. 19, wherein the antenna means is arranged in a carrying handle of a computer.

FIG. 25 shows the first and second antenna parts (39 and 40) in a different embodiment. The connections and electrical lengths of the two pares are given in FIG. 19.

Figure 26:
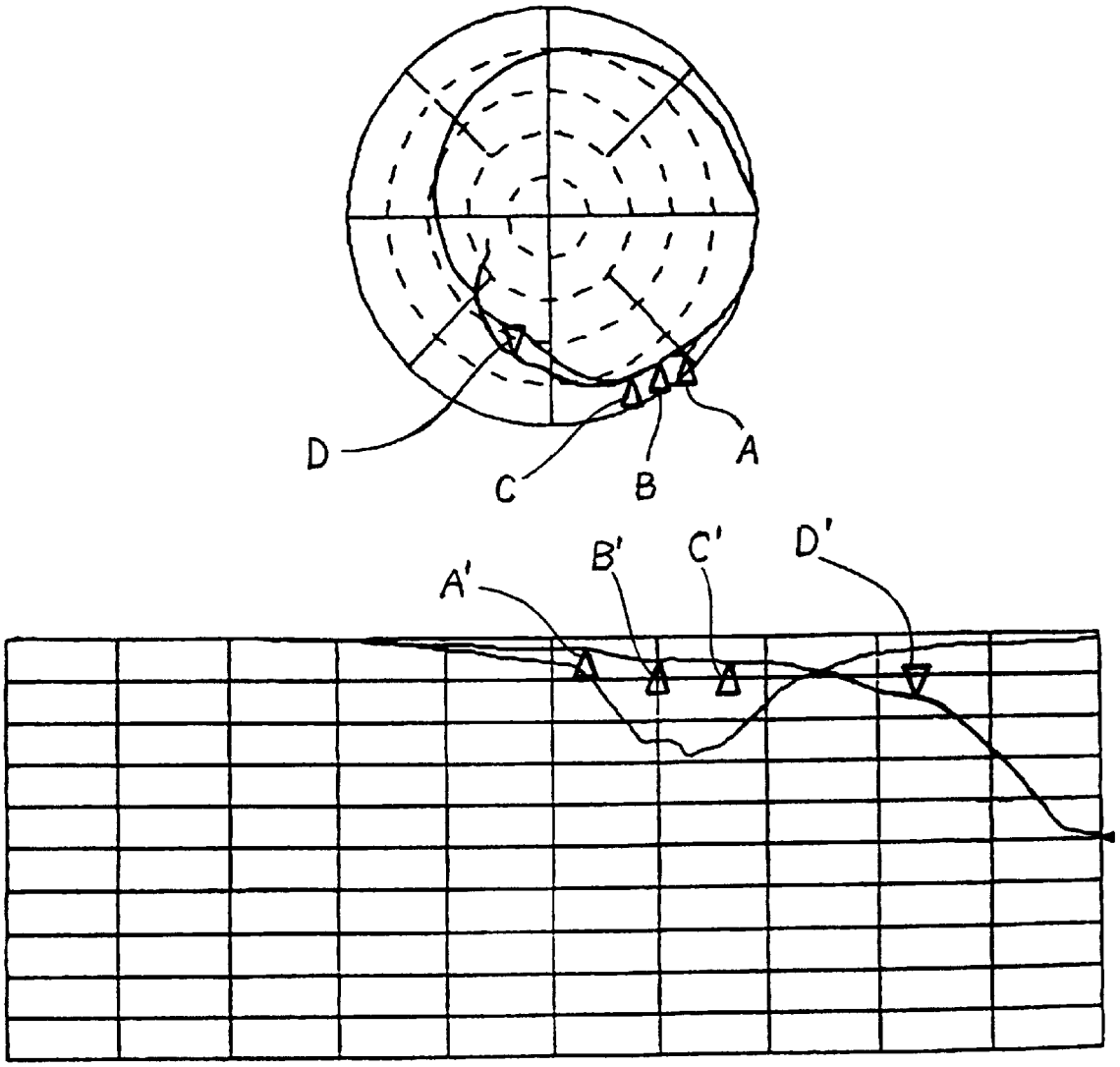
FIG. 26 shows diagrams of experimental results regarding the application of a connecting means according to the invention for enabling the telephone that carries a zigzag or meander antenna element to be connected to an auxiliary antenna via a transmission line.

FIG. 26 shows a measurement result of the S11 Parameter in polar coordinates and logarithmic coordinates of a quarter wave length zigzag antenna. The line, without markers, in both graphs represents the Return—Loss values of the antenna over the frequency band from 30 kHz up at 1.5 GHz. The antenna was mounted on the top of a 15.5 cm* 5 cm*1 cm shielded case. The zigzag antenna was a copper wire of 0.5 mm diameter and it had three bends (shaped like a Z). The "Z" was 3.6 cm wide, 0,5 mm thick and 1 cm high. In the logarithmic diagram, the band without markers has a minimum value at approximately 900 MHz, which means that the antenna had an electrical length of one quarter wavelength for the 900 MHz frequency. The line with the markers represents the return—loss (S11) values over the same frequency range after the zigzags were shorted with a vertical connection smarting from, he feeding point up to the highest zigzag. This shows that the electrical length decreases significantly, causing the S11 values to increase and drastically reducing the amount of transmitted energy at and around 900 MHz. This means that a very low percentage of the 900 MHz signal energy gets transmitted, and therefore nearly all the energy is available to be fed into a transmission line as is dealt with in FIGS. 1, 2, 3, 4, and 5. An alternate embodiment (not shown) of FIG. 1 and 2 is a zigzag antenna that is shorted as in the above section. The shorting conductor is connected to one conductor of a transmission line while another conductor that is parallel to the shorting conductor is in contact with the shielding and is connected to the other conductor of the transmission line.

Figure 27:
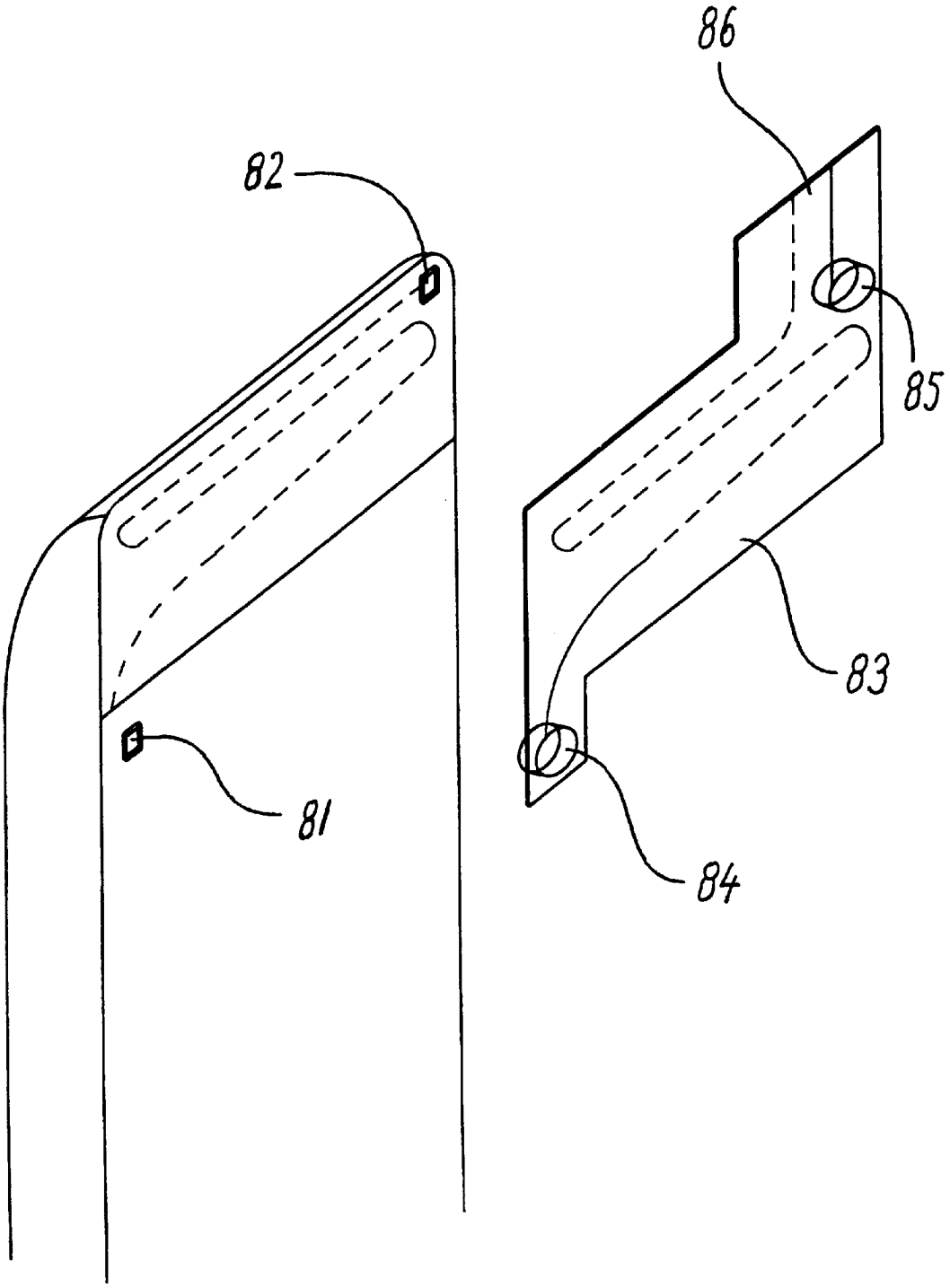
FIG. 27 shows detail of one inventive variation of a combination of an antenna means and an antenna connecting means.

FIG. 27 shows one application of antenna I of FIG. 15 in more detail.

Figure 28:
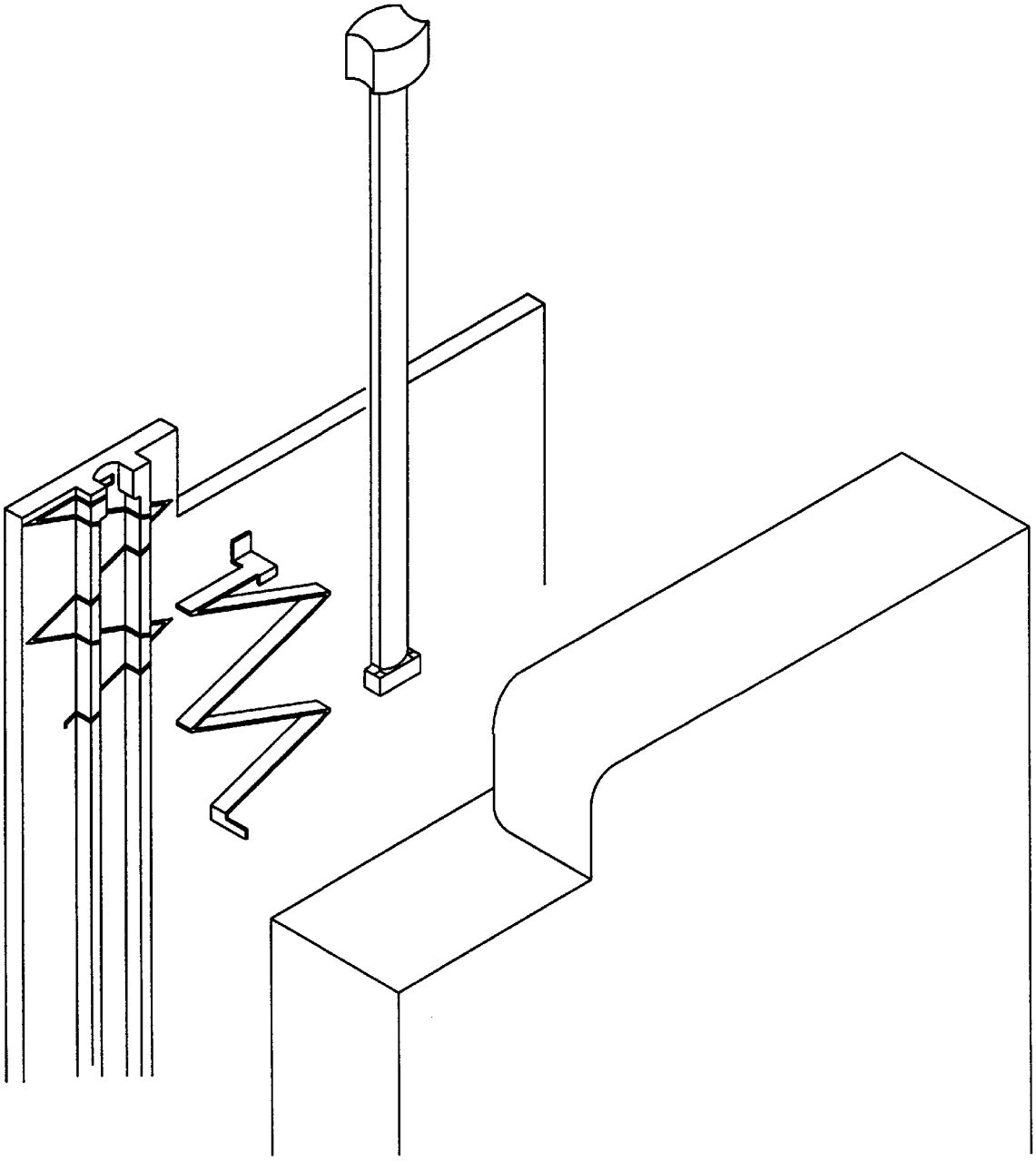
FIG. 28 shows an extendable and retractable straight radiator embodiment of the invention.

FIG. 28 shows an embodiment similar to that of FIGS. 12–14. However, in this embodiment the meander or helical second element 40 is not needed and therefore replaced by a straight or cylindrical wire.

It is to be understood that this embodiment description includes merely illustrative examples of the application of the invention. Thus, many further variations and modifications may be made without departing from the scope of the invention as defined by the appended claims.

In FIG. 26, upper and a lower diagrams show the S11 parameter in polar and logarithmic coordinates, respectively, In the upper diagram, marker A corresponds to the values 933.14 mV, −44.907°, 800 MHz; marker B corresponds to 873.57 mV, −52.5630, 900 MHz; marker C corresponds to 864.18 mV, −62.341°, 1 GHz; and marker D corresponds to 695.14 mV, −104.31°, 1,251.545, 024 Mz. In the lower diagram, marker A' corresponds to the values −0.6010 dB, 800 MHz; marker B' corresponds to −1.1742 dB, 900 MHz; marker C' corresponds to −1.2678 dB, 1 GHz; and marker D' corresponds to −3.158 dB, 1,251.545, 024 MHz. The lower diagram ranges from 30,000 MHz to 1,500.000,000 MHz In the horizontal direction. Its reference value in the vertical direction is −10 dB and there are 2 dB per division.

In FIG. 27, 81 is a ground contact, 82 an internal zigzag contact, 83 an external zigzag, 84 a magnet ground contact, 85 a magnet hot contact, and 86 a parallel transmission line to a car antenna (not shown).

We claim:

1. Antenna connecting means for switch-less connection of a radiating element of a portable radio communication device to a transmission line, characterized by said connecting means comprising:

a transmission line connection interface to which a transmission line is connectable, a transmission line element having first and second ends and being adapted to have a geometrical configuration essentially the same as a geometrical configuration of the radiating element to be connectable to the transmission line via the transmission line connection interface, said second end being connected to the transmission line connection interface, a ground connection member adapted to couple the first end of the transmission line element to a ground potential of the radiating element, a signal connection member adapted to couple the transmission line connection interface to a free end of the radiating element.

2. Antenna connecting means according to claim 1, wherein the transmission line element has essentially a meander configuration without complete turns.

3. Antenna connecting means according to claim 1, wherein the transmission line element is essentially planar.

4. Antenna connecting means for switch-less connection of a radiating element of a portable radio communication device to a transmission line, characterized by said connecting means comprising:

a transmission line connection interface to which a transmission line is connectable, a transmission line element having first and second ends and being adapted to have a geometrical configuration that enables short-circuiting the radiating element to be connected to transmission line via the transmission line connection interface, said second end being connectable to the transmission line connection interface, a ground connection member adapted to couple the transmission line connection interface to a ground potential of the radiating element, a signal connection member adapted to couple the transmission line connection interface to a free end of the radiating element.

5. Antenna connecting means according to claim 4, wherein the transmission line element has essentially helical configuration.

6. Antenna means for a portable radio communication device, comprising:

a radiating first element having a longitudinal first axis, first and second ends being a first feed point and a first open end, respectively, and a meander configuration without complete turns, characterized by a radiating second element having a longitudinal second axis, third and fourth ends being a second and third open ends, respectively, the first and second elements interacting to provide at least one mode of antenna operation, the second open end of the second element being arranged to be fed by the first open end of the first element in said at least one mode of operation.

7. Antenna means according to claim 6, wherein the first element has a length of approximately one quarter of a wavelength at which the antenna means operates, the first element has a length of approximately one half of the said wavelength.

8. Antenna means according to claim 6, wherein the first and second longitudinal axes are essentially parallel in said at least one mode of operation.

9. Antenna means according to claim 6, wherein the first and second longitudinal axes essentially coincide in said at least one mode of operation.

10. Antenna means according to claim 6, wherein the first and second elements are adapted to be arranged, in said at least one mode of operation, in parallel to a side of a hand-portable telephone opposite a side thereof which is intended to face an operator when communicating.

11. Antenna means according to claim 6, wherein the second element is movable between a first position, wherein the antenna means operates in its first mode of operation, and a second position, wherein the second element is essentially decoupled from the first element and the antenna means operates in a second mode of operation, in which the first antenna provides an antenna performance essentially alone.

12. Antenna means according to claim 11, wherein the second element is linearly movable in a plane essentially common to both the first and the second radiating elements.

13. Antenna means according to claim 11, wherein the second antenna means is adapted in its first and second positions to be retracted into and retracted out of a chassis of the portable radio communication device, respectively.

14. Antenna means according to claim 11, wherein the second element is rotatably movable to alter an angle between the first and second axes.

15. Antenna means according to claim 6, wherein the second element has a meander configuration without complete turns.

16. Antenna means according to claim 6, wherein the second element has a helical configuration including complete turns.

17. Antenna means according to claim 6, wherein the second element has a rectangular configuration.

18. Antenna means according to claim 6, wherein the second element has an essentially cylindrical configuration.

* * * * *